US007455384B2

(12) United States Patent
Tezuka

(10) Patent No.: US 7,455,384 B2
(45) Date of Patent: Nov. 25, 2008

(54) LIQUID DISCHARGING APPARATUS, AND METHOD OF PERFORMING MAINTENANCE ON LIQUID DISCHARGING HEAD

(75) Inventor: Mutsuto Tezuka, Shiojiri (JP)

(73) Assignee: Seiko Epson Corporation (JP)

( * ) Notice: Subject to any disclaimer, the term of this patent is extended or adjusted under 35 U.S.C. 154(b) by 431 days.

(21) Appl. No.: 11/328,521

(22) Filed: Jan. 9, 2006

(65) Prior Publication Data

US 2006/0181567 A1 Aug. 17, 2006

(30) Foreign Application Priority Data

Feb. 14, 2005 (JP) ..... 2005-035646

(51) Int. Cl.
*B41J 2/165* (2006.01)

(52) U.S. Cl. ..... 347/23; 347/22; 347/29; 347/30; 347/32; 347/33

(58) Field of Classification Search ..... 347/22–35, 347/37, 104
See application file for complete search history.

(56) References Cited

U.S. PATENT DOCUMENTS

| | | | | |
|---|---|---|---|---|
| 6,299,281 | B1 * | 10/2001 | Shiida et al. | 347/37 |
| 7,036,906 | B2 * | 5/2006 | Takano et al. | 347/37 |
| 7,178,915 | B2 * | 2/2007 | Nakashima et al. | 347/104 |

FOREIGN PATENT DOCUMENTS

| | | |
|---|---|---|
| CN | 1575992 | 2/2005 |
| JP | 10-206624 | 8/1998 |
| JP | 2000-085135 | 3/2000 |
| JP | 2001-171135 | 6/2001 |
| JP | 2003-048312 | 2/2003 |
| JP | 2003-230858 | 8/2003 |

* cited by examiner

*Primary Examiner*—Shih-wen Hsieh
(74) *Attorney, Agent, or Firm*—Harness, Dickey & Pierce, P.L.C.

(57) ABSTRACT

A liquid discharging apparatus includes a table that transfers a workpiece in a first scan direction; a carriage that has a liquid discharging head for discharging liquid droplets on the workpiece, and moves along a guide member in a second scan direction; one or more maintainers that are used to perform maintenance such as cleaning of the liquid discharging head; and transfer units that the transfers the maintainers to a standby position in which the maintainers does not interfere with the table to be scanned, and a maintenance position in which the maintenance of the liquid discharging head is performed. When the maintainers are positioned at the standby position, at least a part of the maintainers is positioned in a workpiece maximum scanning range, which is a maximum moving range of the workpiece in the first scan direction during the scanning of the workpiece on the table. When the maintainers positioned at the maintenance position, at least a part of the maintainers is positioned in a workpiece maximum scanning range of the carriage in the second scan direction, which is a maximum moving range during the scanning of the carriage.

13 Claims, 9 Drawing Sheets

LIQUID DISCHARGING APPARATUS, AND METHOD OF PERFORMING MAINTENANCE ON LIQUID DISCHARGING HEAD

BACKGROUND

1. Technical Field

The present invention relates to a liquid discharging apparatus that transfers a liquid discharging head relative to a workpiece so as to perform a drawing on the workpiece, and more particularly, to a liquid discharging apparatus, which includes maintainers for performing maintenance, such as cleaning, of a liquid discharging head, and a method of performing maintenance on a liquid discharging head.

2. Related Art

An inkjet liquid discharging apparatus in the related art has been known as an apparatus for discharging liquid droplets on the workpiece. For example, such a liquid discharging apparatus is disclosed in JP-A-10-206624 (claim 4, FIG. 1), JP-A-2001-171135 (claim 4, FIG. 1), JP-A-2003-48312 (claim 6, FIG. 1), and JP-A-2003-230858 (claim 3, FIG. 1). The liquid discharging apparatus includes a slide table and an inkjet head (liquid discharging head), and discharge liquid droplets on a workpiece. The workpiece such as a substrate is laid on the slide table, and is transferred in one direction by the slide table. The inkjet head is provided above the slide table, and moves along the guide rail in the direction orthogonal to the moving direction of the slide table.

The liquid discharging apparatus is provided with cleaning devices to cope with the clogging of nozzle of the inkjet head, attachment of dust on the surface of the head, and air bubbles mixed in the liquid in the head. A wiper that wipes the contaminant caused by drying and solidification of a blot on the head nozzle face and liquid, a flusher that discharges air bubbles or thickened liquid in the liquid discharging head, and a capper that caps the surface of the head to intercept air and thus prevents the liquid in the nozzles from being dried, are used as the cleaning devices.

The cleaning devices have been provided so as to be positioned at a side position of the slide table below the guide rail of the inkjet head (JP-A-10-206624 (claim 4, FIG. 1)), so as to be movable along the rail of the slide table (JP-A-2001-171135 (claim 4, FIG. 1), JP-A-2003-48312 (claim 6, FIG. 1)), and so as to be mounted on the slide table (JP-A-2003-230858 (claim 3, FIG. 1)).

However, in the liquid discharging apparatus disclosed in JP-A-10-206624 (claim 4, FIG. 1), during the scanning when the liquid droplets are discharged from the liquid discharging head to perform a drawing, the cleaning device is provided on the outside of the maximum scanning range (drawing range) in which the carriage can move. Accordingly, the carriage should be transferred to a position over the maximum scanning range in order to transfer the liquid discharging head to a position corresponding to the cleaning device. As a result, the guide rail for guiding the carriage is made relatively long so that the carriage can move the position over the maximum scanning range. For this reason, as a length of the guide rail becomes long, there have been problems in that the size of the liquid discharging apparatus becomes larger and the guide rail is easily bent due to the increase in length. Accordingly, the positional accuracy of the liquid droplets (liquid droplet discharge positional accuracy), which are discharged from the liquid discharging head on the workpiece such as a substrate, deteriorates. In particular, as the size of the workpiece such as a substrate is increased, the maximum scanning range becomes larger. Accordingly, the length of the guide rail should become longer. Furthermore, if the weight of the carriage is increased by mounting auxiliary units such as a camera and a measuring device, the guide rail is more easily bent, whereby the liquid droplet discharge positional accuracy further deteriorates.

In addition, in the liquid discharging apparatus disclosed in JP-A-2001-171135 (claim 4, FIG. 1) and JP-A-2003-48312 (claim 6, FIG. 1) in which another moving table is mounted on the rail of the slide table and maintainers are mounted on the another moving table, the maintainers are provided on the outside of a moving range of the slide table, which is required to perform a drawing on the workpiece. Accordingly, the size of the liquid discharging apparatus is increased in the table moving direction.

Furthermore, in the liquid discharging apparatus disclosed in JP-A-2003-230858 (claim 3, FIG. 1) in which the cleaning device is mounted on the slide table, since it is necessary to secure a space for mounting the cleaning device as well as region for laying a substrate on the slide table, the size of the slide table is increased in the table moving direction by the space for mounting the cleaning device. Even in this case, there has been a problem that the size of the liquid discharging apparatus is increased in the table moving direction.

SUMMARY

An advantage of some aspects of the invention is that it provides a liquid discharging apparatus capable of arranging maintainers and securing liquid droplet discharge positional accuracy to be required while keep the size thereof as small as possible, and a method of performing maintenance of a liquid discharging head.

According to an aspect of the invention, a liquid discharging apparatus includes a table-that transfers a workpiece in a first scan direction; a carriage that has a liquid discharging head for discharging liquid droplets on the workpiece, and moves along a guide member in a second scan direction; one or more maintainers that are used to perform maintenance such as cleaning of the liquid discharging head; and transfer units that the transfers the maintainers to a standby position in which the maintainers does not interfere with the table to be scanned, and a maintenance position in which the maintenance of the liquid discharging head is performed. When the maintainers are positioned at the standby position, at least a part of the maintainers is positioned in a workpiece maximum scanning range, which is a maximum moving range of the workpiece in the first scan direction during the scanning of the workpiece on the table. Furthermore, when the maintainers are positioned at the maintenance position, at least a part of the maintainers is positioned in a workpiece maximum scanning range of the carriage in the second scan direction, which is a maximum moving range during the scanning of the carriage.

Here, the 'workpiece maximum scanning range' means a moving range of the workpiece in the first scan direction when the table on which the longest workpiece in the first scan direction is laid is transferred in the maximum stroke in order to perform a scanning that discharges liquid droplets on the workpiece to perform a drawing thereon. The 'workpiece maximum scanning range' is equal to the range between a position of one end (a front end) of the workpiece laid on the table when the table scanned (transferred) in the maximum stroke reaches one end (for example, a front end) in the moving range thereof, and a position of the other end (a rear end) of the workpiece when the table reaches the other end (for example, a rear end) in the moving range thereof.

Moreover, the 'carriage maximum scanning range' means a maximum moving range of the carriage during the time period when the liquid discharging head discharges the liquid droplets from the nozzles thereof to perform a drawing. The carriage maximum scanning range is equal to a moving range of the carriage during the time period when the longest workpiece in the carriage scan direction is laid on the table and the drawing is performed on the workpiece in the maximum range in the carriage scan direction. The carriage maximum scanning range is defined as the range between a right end of the carriage when the carriage reaches the right end, and a left end of the carriage when the carriage reaches the left end. In addition, the first scan direction of the table may be referred to as a main scan direction, and the second scan direction of the carriage may be referred to as a sub-scan direction. Moreover, the first scan direction of the table may be referred to as a sub-scan direction, and the second scan direction of the carriage may be referred to as a main scan direction.

According to the above-mentioned structure, when the maintainers is positioned at the maintenance position in which the maintenance of the liquid discharging head is performed, at least a part of the maintainers is positioned in the maximum scanning range of the carriage during the scanning when the liquid discharging head discharges liquid droplets to perform a drawing. For this reason, it is sufficient as long as the carriage can move in the maximum scanning range. Accordingly, it is possible to set the maximum moving range of the liquid discharging head relatively narrow, and thus to make the guide member of the carriage short. If it is possible to make the guide member short, even though the weight of the carriage is increased by mounting auxiliary units such as a camera and a measuring device, the guide member is hardly bent, whereby it is possible to easily secure the required positional accuracy for discharging liquid droplets. In addition, if the length of the guide member is reduced, it is possible to reduce the size of the liquid discharging apparatus in the carriage moving direction (the second scan direction).

Furthermore, after the maintenance is completed, the maintainers are positioned at the standby position in which the maintainers do not interfere with the table to be scanned. When the maintainers are positioned at the standby position, at least a part of the maintainers is positioned in the workpiece maximum scanning range, which is a maximum moving range of the region for laying the workpiece assumed on the table in the first scan direction. Here, in the liquid discharging apparatus disclosed in JP-A-2001-171135 (claim 4, FIG. 1) and JP-A-2003-48312 (claim 6, FIG. 1), since the table and the common rail are used, the maintainers (cleaning devices) can separately move in the same direction (the first scan direction) as that of the table. Therefore, the maintainers (cleaning devices) should be disposed on the outside of the maximum moving range of the table, which causes the apparatus to be large in the first scan direction. Furthermore, even in the liquid discharging apparatus disclosed in JP-A-2003-230858 (claim 3, FIG. 1), since the maintainers (cleaning device) is mounted on the end of the table (end of the table adjacent to the region for lying the workpiece in the first scan direction), the table maximum moving range (referred to as a table maximum scanning range) becomes longer during the scanning compared to the configuration in which the maintainers is not mounted on the table (that is, the length of the table is reduced in the first scan direction by a length corresponding to the maintainers). For this reason, the size of the liquid discharging apparatus disclosed in JP-A-2003-230858 (claim 3, FIG. 1) is caused to be also large in the first scan direction. In contrast, in the liquid discharging apparatus according to the invention, when being at the standby position, the maintainers are position in the workpiece maximum scanning range (generally, smaller than the table maximum scanning range). Accordingly, it is possible to reduce the size of the apparatus in the first scan direction. According to the liquid discharging apparatus of the invention, it is possible to reduce the size of the apparatus in the first scan direction as well as in the second scan direction. As described above, it is possible to provide a liquid discharging apparatus that can arrange maintainers therein and secure liquid droplet discharge positional accuracy to be required while keeping the size thereof as small as possible.

In the above-mentioned liquid discharging apparatus, it is preferable that at the beginning of the maintenance, the table be withdrawn to a table withdrawal position in which the table does not interfere with the maintainers, and the maintainers be transferred from the standby position to the maintenance position by the transfer units, and it is preferable that after the completion of the maintenance, the maintainers be withdrawn to the standby position from the maintenance position.

According to the above-mentioned structure, during the maintenance, maintainers, the maintainers is positioned at the maintenance position in which at least a part thereof is positioned in the maximum moving range, during the maintenance. However, except for during the maintenance, the maintainers are positioned at the standby position in which the maintainers do not interfere with the table. Accordingly, the scanning of the table is not interrupted during the drawing. In addition, the standby position may be freely set as long as the maintainers can be move from the standby position to the maintenance position, whereby it is possible to easily configure the liquid discharging apparatus.

In the above-mentioned liquid discharging apparatus, it is preferable that the maintainers be positioned at a lower position of the table, which is immediately below the path of the liquid discharging head, serving as a standby position, and it is preferable that the transfer units be lifters that raise and lower the maintainers between the standby position and the maintenance position. Furthermore, in the invention, the path of the liquid discharging head means-a virtual path of the liquid discharging head moving together with the carriage when the carriage is guided by the guide member and is transferred.

According to the above-mentioned structure, mounting spaces for the maintainers include the standby position, and are included in the carriage maximum scanning range. Accordingly, it is effective to reduce the size of the liquid discharging apparatus in the carriage moving direction. Furthermore, since the maintainer is only raised and lowered, the transfer units are composed of only lifters, whereby the transfer units can be composed of simple mechanisms.

In the above-mentioned liquid discharging apparatus, it is preferable that the plurality of maintainers be arranged immediately below the path of the liquid discharging head in one line in the carriage moving direction.

According to the above-mentioned structure, since the plurality of maintainers having various maintenance functions can be set in the maximum scanning range of the carriage, the guide rail of the carriage can be made to have a required minimum length. Therefore, it is possible to reduce the size of the liquid discharging apparatus. Furthermore, since the plurality of maintainers are arranged in one line along the carriage moving direction immediately below the path of the liquid discharging head, during the maintenance, it is possible to transfer the liquid discharging head to the maintenance position of each of the maintainers, by transferring the carriage. Furthermore, since the maintainer is only raised and lowered, the transfer units can be composed of simple mechanisms.

In the above-mentioned liquid discharging apparatus, it is preferable that the plurality of maintainers be arranged at least in one line in the direction substantially parallel to the scan direction of the table, and use the lower position of the table as a standby position, and it is preferable that the transfer units include a first scan direction transfer unit for transferring at least a maintainer of the maintainers which is used to perform maintenance between the standby position and a junction position, which is immediately below the path of the liquid discharging head, in a direction substantially parallel to the scan direction of the table, and lifters for raising and lowering the maintainers between the standby position and the maintenance position.

According to the above-mentioned structure, since the plurality of maintainers is arranged in line in the table scan direction, it is possible to easily secure the mounting spaces for the maintainers in the limited carriage moving range in the carriage scan direction. As a result, since the size of each of the maintainers can be increased in the carriage scan direction, for example, the maintainers can have various functions.

In the above-mentioned liquid discharging apparatus, it is preferable that the maintainers be positioned at the outer position of the table, serving as the standby position, on the extension line of the path of the liquid discharging head.

According to the above-mentioned structure, since the maintainers use a side position of the table, which is the outer position of the table on the extension line of the path of the liquid discharging head, as a standby position, the maintainers do not interfere with the table at the standby position. In addition, since the transfer of the maintainers from the standby position to the maintenance position is achieved by transferring the maintainers in the carriage scan direction, the transfer units can be composed of simple mechanisms. Furthermore, since the maintainers are disposed on the outside (side) of the table, it is possible to easily perform the maintenance of the maintainers.

In the above-mentioned liquid discharging apparatus, it is preferable that the plurality of maintainers be arranged in one line along the scan direction of the carriage, and it is preferable that the transfer units include a second scan direction transfer unit for transferring the maintainers between the standby position and the maintenance position in the second scan direction.

According to the above-mentioned structure, the plurality of maintainers uses a side position of the table, which is the outer position of the table on the extension line of the path of the liquid discharging head, as a standby position, and is arranged in one line along the carriage scan direction. Therefore, the transfer of the maintainers from the standby position to the maintenance position is achieved by transferring the maintainers in the substantially same direction as the carriage scan direction. For this reason, the transfer units can be composed of simple mechanisms. Furthermore, since the maintainers are disposed on the outside (side) of the table, it is possible to easily perform the maintenance of the maintainers.

In the above-mentioned liquid discharging apparatus, it is preferable that one of the plurality of maintainers be positioned on the extension line of the path of the liquid discharging head at the standby position, and the plurality of maintainers be arranged in one line in the scan direction of the table; and it is preferable that the transfer units include a first scan direction transfer unit for transferring a maintainer of the maintainers which is used to perform maintenance between the standby position and a junction position, which is positioned on the extension line of the path of the liquid discharging head, in the first scan direction, and a second scan direction transfer unit for transferring the maintainers between the junction position and the maintenance position in the second scan direction.

According to the above-mentioned structure, since the plurality of maintainers is arranged in one line along the table scan direction at the side position of the table at the standby position, it is possible to further reduce the size of the liquid discharging apparatus in the carriage moving direction compared to the liquid discharging apparatus in which the plurality of maintainers is disposed at the side position of the table. Furthermore, the transfer of the maintainers to the maintenance position is achieved by the combining the first scan direction transfer from the standby position to the junction position, and the second scan direction transfer from the junction position to the maintenance position. Accordingly, the transfer units can be composed of simple mechanisms. In addition, since the maintainers are disposed on the outside (side) of the table, it is possible to easily perform the maintenance of the maintainers.

According to another aspect of the invention, a liquid discharging apparatus includes a table that transfers a workpiece in a first scan direction; a carriage that has a liquid discharging head for discharging liquid droplets on the workpiece, and moves along a guide member in a second scan direction; one or more maintainers that are used to perform maintenance such as cleaning of the liquid discharging head; and transfer units that the transfers the maintainers to a standby position in which the maintainers does not interfere with the table, and a maintenance position in which the maintenance of the liquid discharging head is performed. When being positioned at the standby position, the maintainers are positioned at a lower position of the table in which the maintainers does not interfere with the table to be scanned. Furthermore, the transfer units includes lifters for raising and lowering the maintainers between the height of the standby position and the height of the maintenance position during the period when maintainers moves between the standby position and the maintenance position.

According to the above-mentioned structure, in a standby state in which the maintenance is not performed, the maintainers are positioned at a lower position, that is standby position, of the table in which the maintainers does not interfere with the table to be scanned. When the maintenance is performed, the maintainers are transferred from the standby position to the maintenance position. The transfer (raising and lowering) of the maintainers is performed by the lifters between the height of the standby position and the height of the maintenance position. The maintainers are disposed below the table at the standby position, and are disposed at a position in which the maintenance of the liquid discharging head can be performed, at the maintenance position. That is, the maintainers are always positioned in the workpiece maximum moving range in the first scan direction, and are always positioned in the carriage maximum moving range in the second scan direction. Accordingly, it is possible to provide a liquid discharging apparatus that can arrange maintainers therein and secure liquid droplet discharge positional accuracy to be required while keeping the size thereof as small as possible.

In the above-mentioned liquid discharging apparatus, it is preferable that before the beginning of the maintenance, the liquid discharging head be positioned at a predetermined position, which corresponds to the maintenance position of the maintainers, by transferring the carriage.

According to the above-mentioned structure, the liquid discharging head is positioned at a predetermined position, which corresponds to the maintenance position of the maintainers, by transferring the carriage during the maintenance. Accordingly, even though the liquid discharging head is positioned at any position on the path thereof before the beginning of the maintenance, the maintainers may always move to a determined maintenance position. Therefore, the transfer units can be composed of simple mechanisms.

In the above-mentioned liquid discharging apparatus, it is preferable that at least one of a capper, a wiper, and a flusher, which are used to perform the cleaning of the liquid discharging head, be used as the maintainer.

According to the above-mentioned structure, the capper can prevent the liquid discharging head from being, dried, the wiper can wipe the contaminant on the surface of the liquid discharging head, and the flusher can reliably discharge air bubbles or thickened liquid. Therefore, the liquid discharging apparatus can perform maintenance to reliably discharge liquid droplets.

The above-mentioned liquid discharging apparatus may further include a weight measuring unit that measures the weight of functional liquid to be discharged from the liquid discharging head as the maintainer.

According to the above-mentioned structure, the weight of the functional liquid to be discharged is measured, and for example, whether an amount of one droplet to be discharged is proper is discriminated on the basis of the measured result in order to properly adjust the amount thereof to be discharged. Accordingly, it is possible to improve a quality of the drawing.

According to still another aspect of the invention, a method of performing maintenance of the above-mentioned liquid discharging head includes transferring a table to a table withdrawal position in which the table does not interfere with maintainers; transferring the maintainers from a standby position to a maintenance position; positioning the liquid discharging head at a predetermined position so as to correspond to the maintainers positioned at a maintenance position by transferring the carriage; and performing maintenance on the liquid discharging head by the maintainers positioned at a maintenance position. In addition, the order of the transferring of the table, and the positioning of the liquid discharging head is not limited thereto. That is, the transferring of the table and the positioning of the liquid discharging head may be performed simultaneously, or may be performed in the reverse order. Furthermore, the order of the transferring of the maintainers and the positioning of the liquid discharging head is not limited thereto. That is, the transferring of the maintainers and the positioning of the liquid discharging head may be performed simultaneously, or may be performed in the reverse order.

According to the above-mentioned method, when the maintenance is performed, the table is withdrawn to the table withdrawal position and thus the maintainers can be transferred to the maintenance position. Accordingly, the maintainers are transferred from the standby position to the maintenance position. At about that time, the liquid discharging head is positioned so as to correspond to the maintainer positioned at the maintenance position by transferring the carriage. In this manner, when the maintainers and the liquid discharging head are positioned at corresponding positions, the maintenance is performed. For example, even though there is no mounting space for the maintainers on the table, maintainers can stay in a position overlapped with the table in a plan view. Therefore, it is possible to reduce the size of the liquid discharging apparatus. In addition, if the transferring a table, and the positioning of the liquid discharging head are performed simultaneously, or the transferring of the maintainers to the maintenance position and the positioning of the liquid discharging head are performed simultaneously, it is possible to reduce the time required to perform maintenance.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention will be described in detail with reference to FIGS. 1 to 5.

First Embodiment

Figure 1:
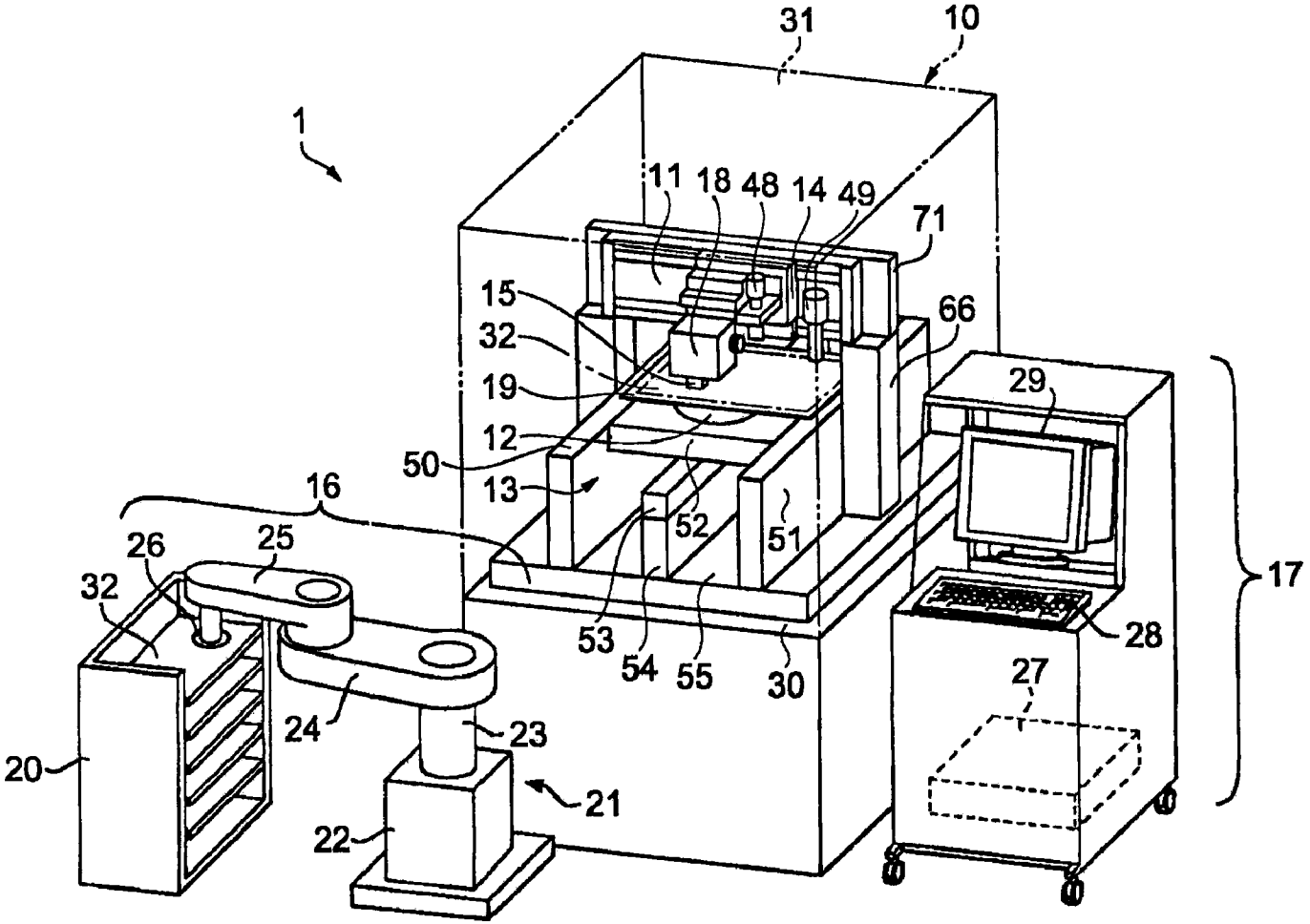
FIG. 1 is a perspective view showing a configuration of a liquid discharging system of a first embodiment.

First, a liquid discharging apparatus will be described. FIG. 1 is a perspective view showing a configuration of a liquid discharging apparatus. The liquid discharging system 1 is a system that discharges a functional liquid in the form of a droplet. That is, the liquid discharging system discharges the functional liquid at a predetermined position on a substrate 32 serving as a workpiece in order to attach the functional liquid on the substrate.

In FIG. 1, the liquid discharging system 1 includes a liquid discharging apparatus 10, a substrate feeding apparatus 16, and a control device 17. The substrate feeding apparatus 16 feeds the substrate 32 at a predetermined working position in the liquid discharging apparatus 10. The control device 17 controls the whole liquid discharging apparatus 10 and the substrate feeding apparatus 16.

The liquid discharging apparatus 10 includes a carriage 18 having a liquid discharging head 15 on the lower side thereof, a head position controller 11 for controlling a position of the liquid discharging head 15, a suction table 19 on which the substrate 32 is attached at a predetermined position by vacuum, a substrate position controller 12 for correcting a position of the substrate 32 set on the suction table 19, a main scan driver 13 for performing a main scanning movement of the substrate 32 with respect to the liquid discharging head 15, a sub-scan driver 14 for performing a sub-scanning movement of the liquid discharging head 15 with respect to the substrate 32, a maintenance units 61 and 62 (see FIGS. 2 and 3), and the like.

The head position controller 11, the substrate position controller 12, the main scan driver 13, and the sub-scan driver 14 are mounted on a base 30. In addition, these units are covered with a cover 31 if necessary.

The substrate feeding apparatus 16 includes a substrate receiving part 20 for receiving the substrate 32, and a robot 21 for transferring the substrate 32. The robot 21 includes a base member 22 laid on a mounting surface such as a floor, the ground, or the like, a shaft 23 for moving up and down with respect to the base member 22, a first arm 24 to be rotated about the shaft 23, a second arm 25 to be rotated with respect to the first arm 24, and a vacuum pad 26 provided on the lower surface of the tip of the second arm 25. The substrate 32 can be attached to the vacuum pad 26 by an air suction force.

A head camera 48, which is mounted on the carriage 18 so as to move with the liquid discharging head 15 as one unit, is provided in the vicinity of the liquid discharging head 15. Furthermore, a substrate camera 49, which is supported by a supporting unit (not shown) mounted on the base 30, is provided at a position where the substrate 32 can be photographed by the substrate camera.

The head camera 48 is used to monitor the discharging condition of the liquid droplet. The head camera 48 is focused on the surface of the substrate 32 so as to be used in measuring positional accuracy of the landing point of the liquid droplet, and monitoring a state of the liquid droplet. A cleaning timing is determined by detecting the bending of the discharged liquid, which is caused by the contamination of nozzles of the liquid discharging head 15. The head camera 48 includes an imaging part and a light source, and the imaging part may be a CCD type imaging part or an electronic imaging part.

The liquid discharging head 15 mounted on the lower surface of the carriage 18 is provided with a plurality of nozzles. The liquid discharging head 15 may have a structure in which a plurality of inkjet type liquid discharging heads is arranged.

The base 30 serving as an essential component included in the liquid discharging apparatus 10 is made of a material, which is hardly affected (deformed) by temperature and humidity, in order to secure levelness of the structure including the suction table 19 mounted on the base 30. In addition, the base 30 includes a vibration removing unit (mot shown) that prevents the vibration from the floor from being received in the base, and is made of a heavy material in order to lower the natural frequency thereof. In the present embodiment, a stone is used as a material of the base 30. Definitely, if the base 30 is used in an environment that is kept in temperature and humidity not affecting the base, a material to be easily treated, such as metal, can be used as the material of the base.

Figure 2:
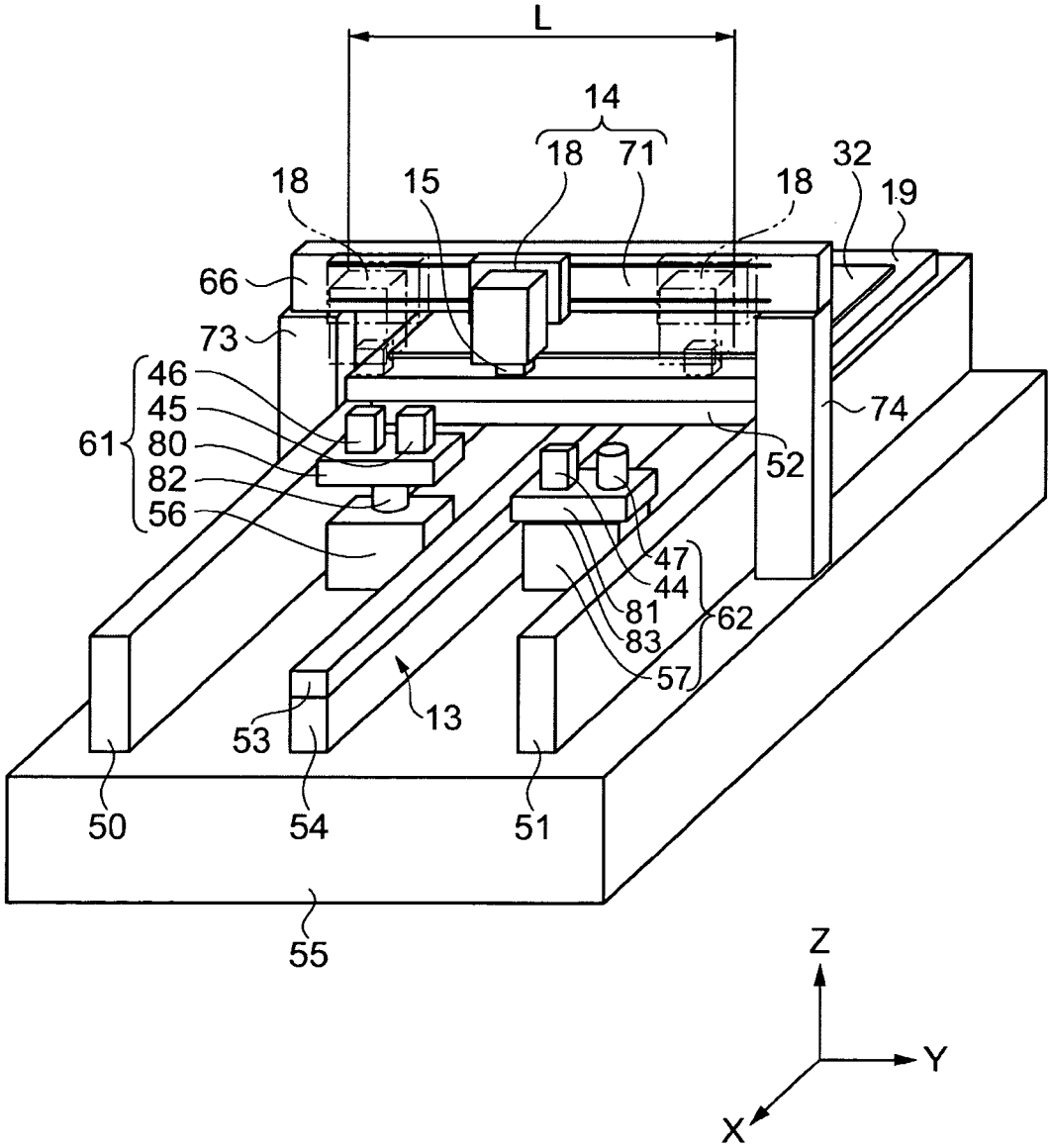
FIG. 2 is a perspective view showing a configuration of a liquid discharging apparatus.

A base plate 55 is provided on the base 30, and the main scan driver 13 is provided on the base plate 55. As shown in FIG. 2, the main scan driver 13 includes guide rails 50 and 51, a movable table 52, a linear motor 53, a motor supporter 54, and the like. To make the table go straighter, an air slide system using air as a lubricant member is used in the sliding part between the guide rails 50 and 51, and the movable table 52. A linear guide using balls or rollers as lubricant members may be used in the sliding part. Although the linear motor has been used as a driving source, a stepping motor and a ball screw may be used in transmitting power.

The substrate position controller 12 is provided above the movable table 52. The substrate position controller 12 turns the suction table 19, and includes a stepping motor and a speed reduction mechanism. The speed reduction mechanism is preferably a mechanism in which backlash does not occur, such as a harmonic drive. A positioning mark is formed on the substrate 32, and the substrate camera 49 (see FIG. 1) measures a position of the positioning mark. The suction table 19 is turned on the basis of a gap between a reference angle and the measured angle of the positioning mark to align the substrate 32.

Next, the sub-scan driver 14 will be described. The sub-scan driver 14 is supported by a gate type support frame 66 provided on the base plate 55. The gate type support frame 66 is provided over the main scan driver 13, and both legs 73 and 74 stands on the outside of the main scan driver 13 with the substantially same width as that of the guide rails 50 and 51.

The sub-scan driver 14 operates in the Y direction (second scan direction), and is provided so as to be substantially orthogonal to the main scan driver 13 operating in the X direction (first scan direction). The sub-scan driver 14 includes a guide rail 71 serving as a guide member composing a horizontal member of the gate type support frame 66, and a carriage 18 moving along the guide rail 71. An air slide system is used in the sliding part between the carriage 18 and the guide rail 71 in the present embodiment. A linear guide using balls or rollers as lubricant members may be used in the sliding part.

The head position controller 11 is a unit for transferring the carriage 18 in the height direction (Z direction), and has a function for adjusting a distance between the liquid discharging head 15 and the substrate 32. In detail, the guide rail 71 includes a stationary rail that is integrally fixed to the legs of the support frame 66, and a movable rail that supports the carriage 18 and can move in the vertical direction with respect to the stationary rail. The head position controller 11 is a unit for transferring the movable rail composing the guide rail 71 in the vertical direction (Z direction), and adjusts a position of the carriage 18 in the vertical direction (Z direction) by transferring the movable rail. An operator inputs a thickness value of the substrate 32 to the control device 17, and then the head position controller 11 positions the carriage 18 at a proper position in the Z direction on the basis of the thickness value. In addition, a method, which occasionally measures the distance between the liquid discharging head 15 and the substrate 32 by means of a distance sensor mounted on the carriage 18 and then adjusts the position of the carriage on the basis of the measuring result thereof, may be adopted as a method of adjusting a position of the carriage 18 in the Z direction. The distance sensor may be any one of an optical distance sensor, a capacitance type distance sensor, an electromagnetic distance sensor, and a contact type distance sensor.

The control device 17 includes a computer main body 27 receiving a processor, a keyboard 28 serving as an input unit, and a display 29 such as a CRT serving as a displaying unit.

Figure 3A:
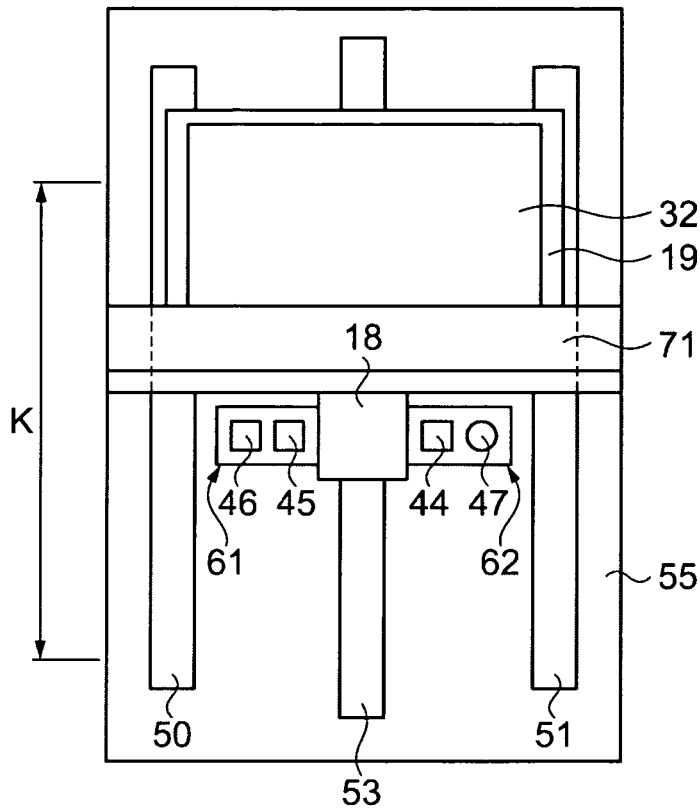
FIG. 3A is a plan view showing a configuration of the liquid discharging apparatus.
Figure 3B:
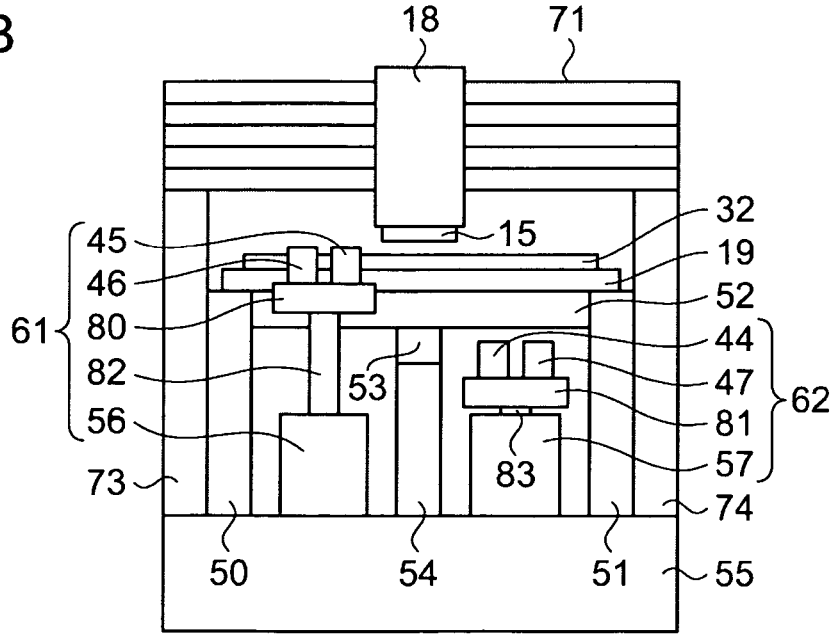
FIG. 3B is a front view showing a configuration of the liquid discharging apparatus.

Hereinafter, the maintainers of the liquid discharging apparatus 10 will be described in detail with reference to FIGS. 2 and 3. FIG. 2 is a perspective view showing a structure provided on the base of the liquid discharging apparatus, and FIG. 3A is a plan view thereof and FIG. 3B is a front view thereof.

As shown in FIG. 2, a first maintenance unit 61 and a second maintenance unit 62 are provided on the base plate 55. The first maintenance unit 61 and the second maintenance unit 62 perform maintenance, which includes cleaning of the liquid discharging head 15. On the upper surface of the base plate 55, the first maintenance unit 61 is provided between the guide rail 50 and the motor supporter 54, and the second maintenance unit 62 is provided between the guide rail 51 and the motor supporter 54. Since the first maintenance unit 61 and the second maintenance unit 62 are disposed at a position which is overlapped with the scanning area of the suction table 19 in plan view, the guide rails 50 and 51 and the motor supporter 54 have a height (length in the Z direction) from the base plate 55 so that the required space in the height direction is secured between the base plate 55 and the suction table 19. Alternatively, if recess portions are formed on the upper surface of the base plate 55 and the maintenance units are disposed in the recess portions, the guide rails 50 and 51 and the motor supporter 54 may also not have a height from the base plate 55.

The first maintenance unit 61 includes a lifter 56 mounted on the base plate 55 and a movable plate 80 fixed to a tip of the rod of the lifter 56, and a flusher 45 and a wiper 46 are disposed on the upper surface of the movable plate 80. Meanwhile, the second maintenance unit 62 includes a lifter 57 and a movable plate 81 similar to those of the first maintenance unit 61, and a capper 44 and an electronic balance 47 are disposed on the upper surface of the movable plate 81. The capper 44, the flusher 45, the wiper 46, and the electronic balance 47, which are disposed on the movable plate 81, are arranged in a row in a carriage moving direction (Y direction). Then, the first and the second maintenance units 61 and 62 are provided at predetermined positions on the base plate 55 so that the capper, the flusher, the wiper, and the electronic balance are disposed immediately below the path of the liquid discharging head 15. In this specification, the capper 44, the flusher 45, the wiper 46, and the electronic balance 47 may be referred to as maintainers. Each of the lifters 56 and 57 is composed of an air cylinder. Furthermore, each of the lifters is not limited to the air cylinder, and may be composed of a hydraulic cylinder, or a stepping motor and a ball screw.

The flusher 45 and the wiper 46 are raised or lowered by projecting or retracting the rod of the lifter 56. When the rod is retracted, the flusher and the wiper are positioned at a standby position, and when the rod is projected, the flusher and the wiper are positioned at a maintenance position. Furthermore, in the same manner, the capper 44 and the electronic balance 47 are raised or lowered by projecting or retracting the rod of the lifter 57. When the rod is retracted, the capper and the electronic balance are positioned at a standby position, and when the rod is projected, the capper and the electronic balance are positioned at a maintenance position. When the maintainers 44 to 47 are positioned at the standby position, the maintainers 44 to 47 are positioned below the lower surface of the movable table 52. Accordingly, the maintainers 44 to 47 do not interfere with the movable table 52 during the scanning period. Meanwhile, when the maintainers 44 to 47 are positioned at the maintenance position, the maintainers 44 to 47 are positioned at respective positions in which maintenance, such as the capping of the liquid discharging head 15, the reception/absorption of discharged liquid during the flushing period, the wiping, and the measuring the weight of the liquid droplet, can be performed.

During the drawing period (scanning period) when the liquid discharging head 15 discharges the liquid droplets on the substrate 32 to draw patterns such as pixels or wiring lines, the maintainers 44 to 47 are lowered and then are positioned at the standby position below the movable table 52. Only one, which supports a required maintenance unit of the maintainers 44 to 47, of the lifters 56 and 57 is operated so that the required maintenance unit is raised and positioned at the maintenance position at the beginning of the maintenance, and so that the required maintenance unit is lowered and returns to the standby position at the beginning of the maintenance after the maintenance. At the beginning of the maintenance, before the required maintenance unit is positioned at the maintenance position, the suction table 19 moves in the X direction to be withdrawn to a table withdrawal position shown in FIG. 2. Accordingly, the suction table does not prevent the maintenance unit from being positioned at the maintenance position.

In addition, at the beginning of the maintenance, the carriage 18 is transferred along the guide rail 71 in the Y direction so that the liquid discharging head 15 is disposed immediately above a position in which the maintenance unit positioned at the maintenance position and the liquid discharging head can face to each other. Accordingly, the liquid discharging head 15 is positioned at a predetermined position in which the maintenance of the liquid discharging head can be performed by the maintenance unit.

The capper 44, the flusher 45, and the wiper 46 serving as maintainers are cleaning units that perform cleaning maintenance to maintain the performance of discharging liquid droplets of the liquid discharging head 15 well. Furthermore, the capper, the flusher, and the wiper function to maintain the nozzles or the functional liquid in the nozzle in a clean state, and to restore the nozzles or the functional liquid in the nozzle to the clean state. When the liquid discharging head 15 is positioned at the standby position (home position) on the path thereof, the capper 44 caps the liquid discharging head 15 in order to prevent menisci of the functional liquid in the nozzles from being dried. The capper 44 includes a box shaped cap that has an opened upper surface, and presses the box shaped cap against the nozzle face to seal up the nozzle face. The box shaped cap is provided with an elastic element to improve the airtightness of contact portion between the liquid discharging head 15 and the box shaped cap.

The flusher 45 is a unit for receiving the liquid droplets discharged from the nozzles of the liquid discharging head 15 during the flushing period when the liquid droplets are successively discharged from the nozzles of the liquid discharging head 15 to discharge the functional liquid and air bubbles in the nozzles. The flusher includes a box shaped container. When the flusher 45 according to the present embodiment is operated at the maintenance position, the container comes in close contact with the liquid discharging head 15 and covers the nozzle face to prevent the scatter of the liquid droplets discharged from the nozzles. The liquid discharged by flushing from the liquid discharging head 15 is sucked by a vacuum pump thorough the tube connected to the container so as to be collected in the tank (not shown).

The wiper 46 is a unit for wiping the nozzle face of the liquid discharging head 15. In the present embodiment, a wiper, (for example, a wiper disclosed in JP-A-2001-171135) which wipes off with a tape shaped cloth soaked in clearing solvent, is adopted as the wiper 46. A wiper, which wipes off with an elastic member such as a rubber plate and a plastic plate, may be adopted as the wiper.

The electronic balance 47 is a unit for measuring the weight of the discharged liquid, and the measured value is transmitted to the control device 17. For example, one hundred liquid droplets are discharged from each of the nozzles of the liquid discharging head 15, and then the weight thereof is measured. The control device 17 adjusts a discharge control signal transmitted to the liquid discharging head 15 on the basis of the measured value of the electronic balance 47, and thus adjusts the size (weight) of the liquid droplet to be discharged.

A range of L shown in FIG. 2 is a maximum moving range (hereinafter, referred to as a carriage maximum scanning range) of the carriage 18 during the time period when the carriage 18 performs a scan. That is, the carriage maximum scanning range L means a maximum moving range of the carriage 18 during the time period when the liquid discharging head 15 discharges the liquid droplets from the nozzles thereof to draw predetermined patterns such as elements or wiring lines on the substrate 32, and during the time period when the liquid discharging head scans and draws in the maximum drawing range. In other words, the carriage maximum scanning range means the range between a position when the carriage 18 reaches the left end, and a position when the carriage 18 reaches the right end in a case in which the carriage 18 moves in the maximum range during the scanning period. Moreover, the range L means a moving range of the carriage 18 during the time period when the longest workpiece in the carriage moving direction is laid on the suction table 19 and the carriage draws patterns on the workpiece in the maximum range in the carriage moving direction. In addition, the suction table 19 may be configured so that the various workpieces having different size can be laid thereon, and may be configured so that the only one kind of workpiece having single size can be laid thereon. Specifically, when one kind of workpiece can be laid on the suction table 19 only in one direction, a length in the moving direction of the carriage on which the workpiece is laid in the one direction is regarded as the longest length.

In the present embodiment, the maintenance, which includes the cleaning of the liquid discharging head 15 or the measurement of the weight of the liquid droplets, can be performed in a state in which the maintainers 44 to 47 are positioned at predetermined positions in the carriage maximum scanning range L. For this reason, the maximum moving range (substantially equal to a guide groove of the guide rail 71) in which the carriage 18 can be transferred along the guide rail 71 becomes substantially equal to the carriage maximum scanning range by providing margin ranges on the both sides of the carriage maximum scanning range L. A length of the guide rail 71 is defined by adding the ranges of the portions supported by the legs 73 and 74 to the both sides of the carriage maximum scanning range L, respectively.

Even when the maintainers 44 to 47 are positioned at any one position of the standby position and the maintenance position, all of the four maintainers is positioned in the carriage maximum scanning range L in the carriage moving direction (Y direction). Particularly, in the present embodiment, even when the maintainers 44 to 47 are positioned at any one position of the standby position and the maintenance position, two maintainers positioned close-to the middle in the carriage moving direction (Y direction) are completely positioned in a head maximum scanning range (a maximum moving range of the liquid discharging head 15 in the Y direction during the scanning period), and two remainder maintainers positioned close to the both sides are completely or partially positioned in the head maximum scanning range. Furthermore, even when the maintainers 44 to 47 are positioned at any one position of the standby position and the maintenance position, all of the four maintainers in the table moving direction (X direction) is positioned in a maximum moving range K (see FIG. 3) (hereinafter, referred to as a workpiece maximum scanning range) of the substrate 32 at the time when the longest substrate (workpiece) 32 in the X direction is laid on the suction table 19 and scanned. Here, when a guiding unit for positioning the substrate 32 (a unit which includes a plurality of guide pins or guide plates projectably provided on the set surface (suction surface) of the table, and an actuator for actuating the guide pins or guide plates) is mounted on the suction table 19, a laid region of the suction table 19, on which the longest substrate (workpiece) 32 in the X direction is laid, can be specified from the longest guided region in the X direction, which is guided by a guiding unit.

In addition, when the suction table 19, on which the longest substrate (workpiece) 32 in the X direction is laid, is scanned in the maximum stroke, the workpiece maximum scanning range is equal to the range between a position of one end (a front end) of the workpiece when the suction table 19 reaches one end (for example, a front end) in the moving range thereof, and a position of the other end (a rear end) of the workpiece when the suction table 19 reaches the other end (for example, a rear end) in the moving range thereof. Furthermore, in FIG. 3, since the suction table 19 is positioned at the table withdrawal position during not the scanning period but the maintenance period, the substrate (workpiece) 32 is positioned so as to be protruded from the workpiece maximum scanning range K.

Figure 4:
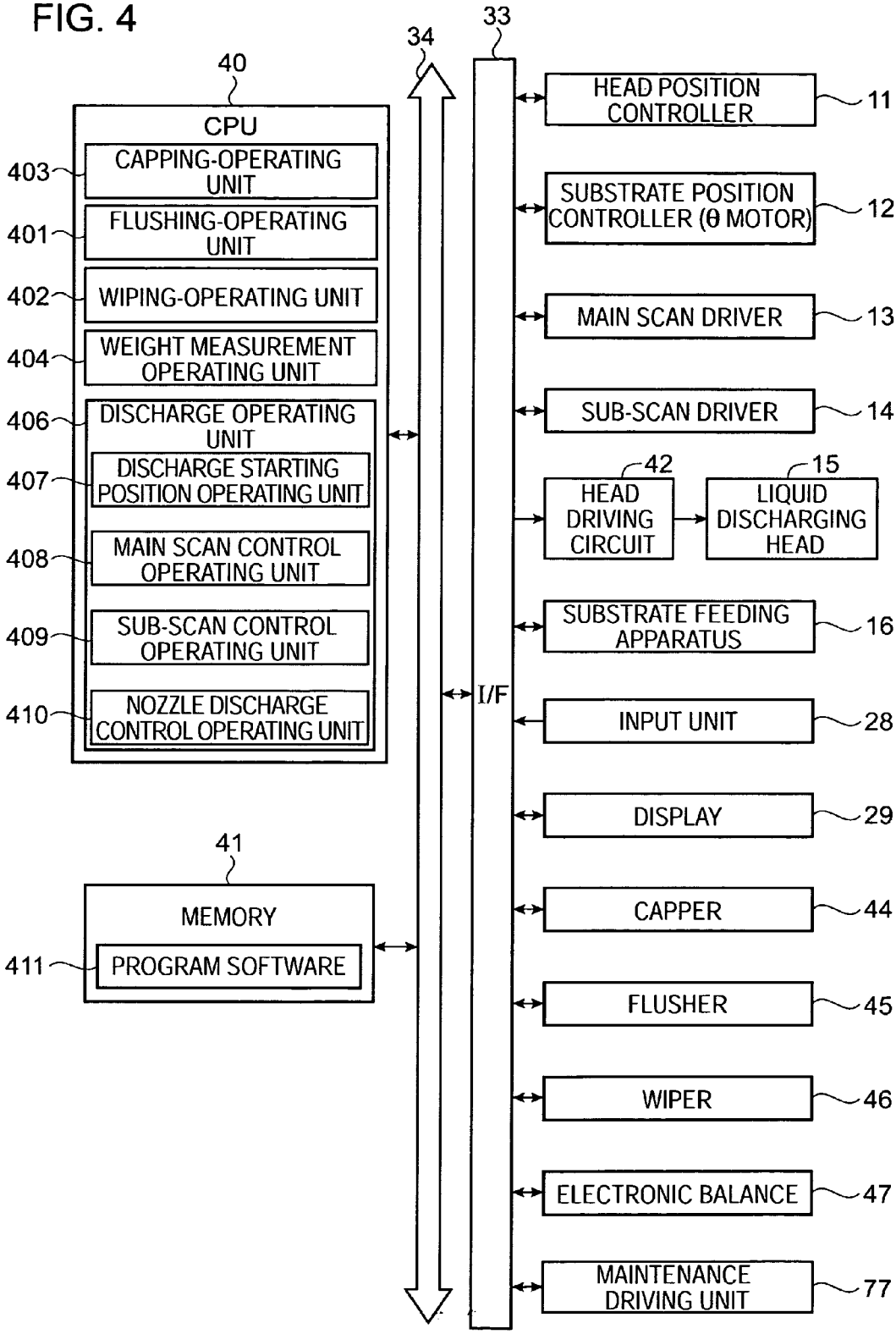
FIG. 4 is an electric control block diagram of the liquid discharging apparatus.

FIG. 4 is an electric control block diagram of the liquid discharging apparatus 10. In FIG. 4, the liquid discharging apparatus includes a CPU 40(central processing unit) serving as a processor, which performs various processes, and a memory 41 for storing various information.

A head driving circuit 42, which drives the head position controller 11, the substrate position controller 12, the main scan driver 13, the sub-scan driver 14, and the liquid discharging head 15, is connected to the CPU 40 through an input/output interface 33 and a bus 34. In addition, the substrate feeding apparatus 16, the input unit 28, the display 29, the capper 44, the flusher 45, the wiper 46, the electronic balance 47, and a maintenance driving unit 77 are also connected to the CPU 40 through the input/output interface 33 and the bus 34.

The memory 41 includes a semiconductor memory such as RAM, ROM, etc., and an external memory unit such as hard disk, CD-ROM, etc. Functionally, the following storage regions are set in the memory. The storage regions includes a storage region that stores program software 411 having operational control procedures of the liquid discharging apparatus 10 therein, a storage region that stores discharge positions on the substrate 32 as coordinate data, a storage region that stores a sub-scan moving distance in a sub-scan direction Y, a storage region that functions as a workpiece area or a temporary file for the CPU 40, or the like.

The CPU 40 performs a control for discharging the functional liquid in the form of the droplet on the substrate 32 on the basis of the program software 411 stored in the memory 41. The CPU includes a flushing-operating unit 401 for performing a flushing process, a wiping-operating unit 402 for performing a wiping process, a capping-operating unit 403 for performing a capping process, a weight measurement operating unit 404 for performing a weight measurement by means of the electronic balance 47, and a discharge operating unit 406 for performing an operation to discharge liquid droplets by means of the liquid discharging head 15, as specific functional parts.

Each of the flushing-operating unit 401, the wiping-operating unit 402, the capping-operating unit 403, and the weight measurement operating unit 404 operates a timing when the maintenance corresponding to each of the maintenance content thereof is performed in the maintainers 44 to 47. When any one of the maintainers 44 to 47 reaches the maintenance timing previously operated, the CPU 40 controls the maintenance driving unit 77 so that a corresponding maintenance unit is transferred (raised) to the maintenance position, and the corresponding maintenance unit returns (is lowered) to the standby position after the completion of the maintenance. In the present embodiment in which each of the lifter 56 and 57 is composed of an air cylinder, the maintenance driving unit 77 is composed of an electromagnetic valve, which is provided on the pipe connected to the air cylinder, in order to control the supply and exhaust of compressed air that is required to operate the air cylinder.

The CPU 40 controls the lifters (air cylinders) 56 and 57 composing the maintenance driving unit 77 by transmitting a switching signal to one of the electromagnetic valves corresponding to the lifters 56 and 57. In addition, although each of the lifters 56 and 57 is composed of an air cylinder in the present embodiment, each of the lifters may be a linear driving unit and is not limited thereto. Furthermore, a hydraulic cylinder or an electric direct acting type actuator can be adopted as each of the lifters. When each of the lifters is composed of the hydraulic cylinder, the maintenance driving unit 77 is composed of a hydraulic pump and an electromagnetic valve. Accordingly, the maintenance driving unit 77 is controlled so as to be driven by transmitting a driving signal of the hydraulic pump or a switching signal of the electromagnetic valve. Moreover, when each of the lifters is composed of the electric direct acting type actuator, the maintenance driving unit 77 is composed of a driving source of the electric direct acting type actuator, that is, a motor, and the like. Accordingly, the maintenance driving unit 77 is controlled so as to be driven by transmitting a driving signal.

According to the detailed structure of the discharge operating unit 406, the discharge operating unit includes a discharge starting position operating unit 407 that sets the liquid discharging head 15 to the initial position in order to discharge liquid droplets, a main scan control operating unit 408 that performs a control for performing a scanning movement of the substrate 32 in a main scan direction X at a predetermined speed, a sub-scan control operating unit 409 that performs a control for transferring the liquid discharging head 15 in the sub-scan direction Y by a predetermined sub-scan distance, a nozzle discharge control operating unit 410 that operates whether the functional liquid is made to be discharged by operating any one of a plurality of nozzles of the liquid discharging head 15, etc. as various functional parts.

Moreover, the above-mentioned functions are performed by means of the program software executed by the CPU 40 in the present embodiment. However, if the above-mentioned functions can be performed by independent electronic circuits (hardware) not using the CPU, it is possible to use the above-mentioned electronic circuits.

Figure 5A:
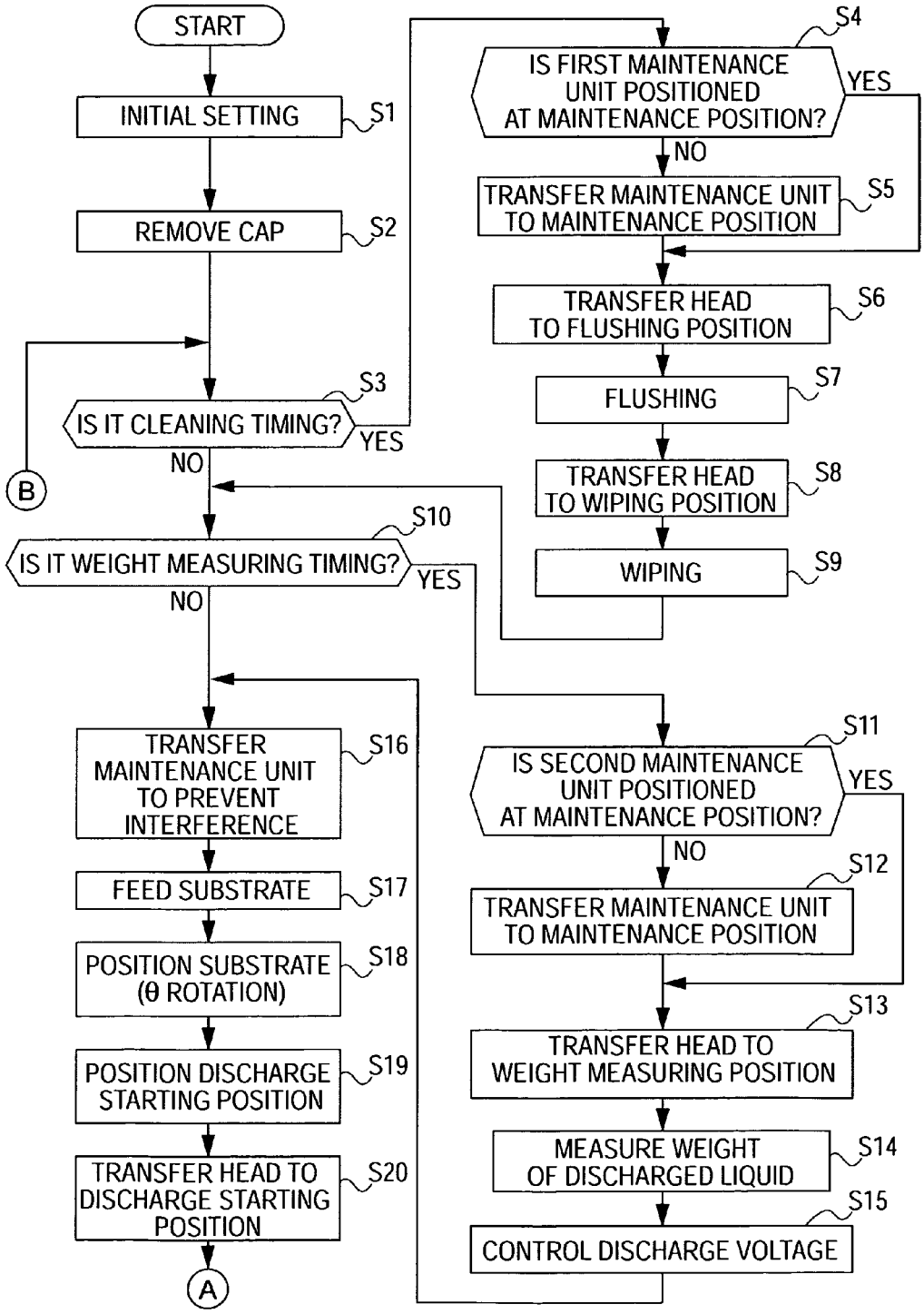
FIGS. 5A and 5B are flow charts showing operation of the liquid discharging apparatus.
Figure 5B:
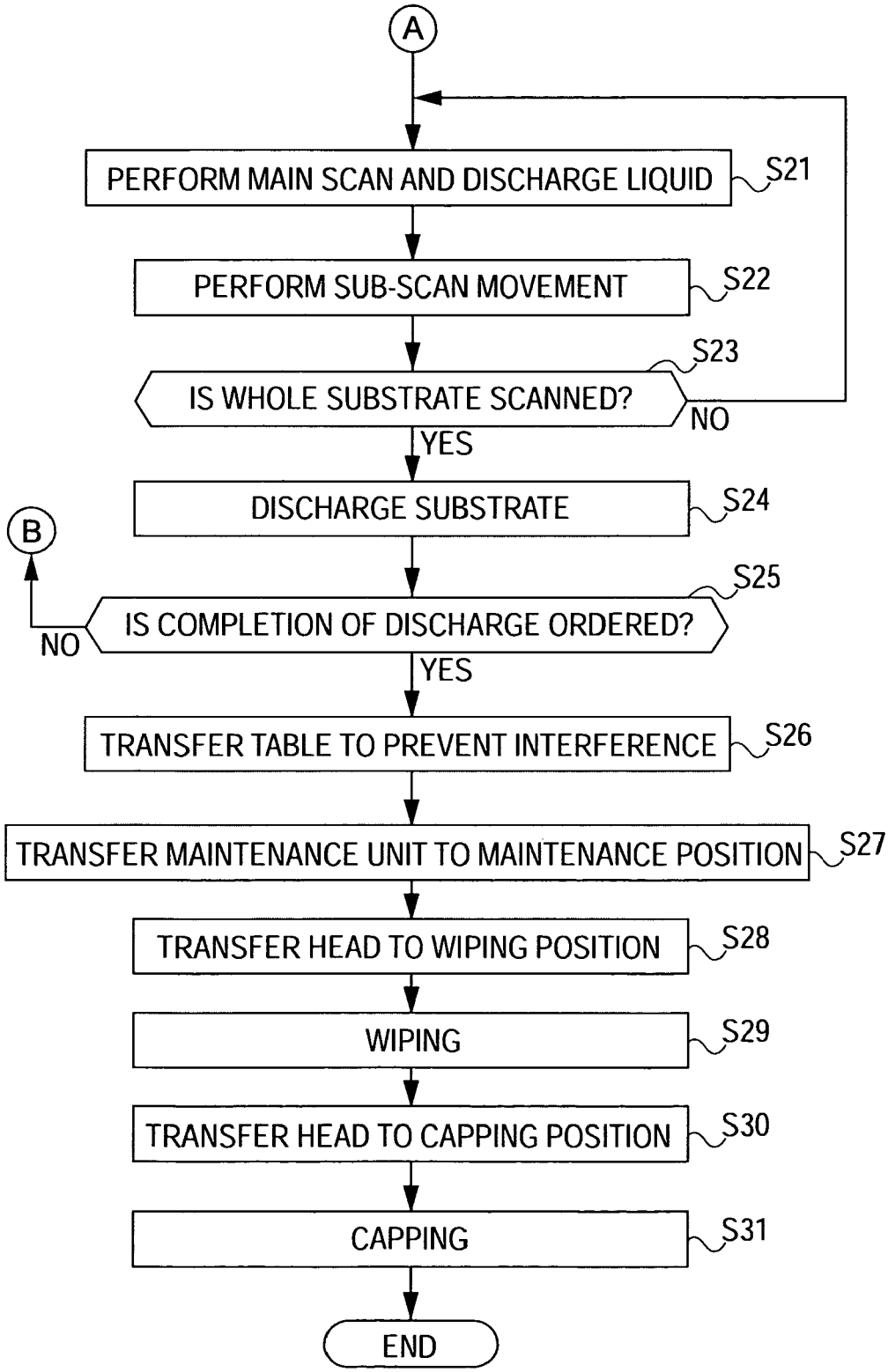

Next, the operation of the liquid discharging apparatus 10 will be described with reference to FIGS. 5A and 5B. First, in the liquid discharging apparatus 10 before the supply of power, the suction table 19 is positioned at the table withdrawal position. Furthermore, the liquid discharging head 15 is positioned at the home position (standby position), and is capped by the capper 44. The second maintenance unit 62 including the capper 44 is positioned at the maintenance position, and the first maintenance unit 61 is positioned at the standby position. When the operator supply power to the liquid discharging apparatus, the liquid discharging apparatus 10 is operated and an initial setting is executed (step S1). Specifically, the carriage 18, the substrate feeding apparatus 16, or the control device 17 is set in the predetermined initial state. After that, the cap is removed so as to discharge liquid (step S2). That is, the CPU 40 drives the maintenance driving unit 77 to remove the cap of the capper 44 from the liquid discharging head 15, and drives the lifter 57 to lower the capper 44 and the electronic balance 47 to the standby position. In this manner, the first and the second maintenance units 61 and 62 are positioned at the standby position.

Next, when it is a cleaning timing (YES in a step S3), a cleaning operation is started. If the first maintenance unit 61 is not positioned at the maintenance position (NO in a step S4) and the suction table 19 is not withdrawn, the suction table 19 is withdrawn to the table withdrawal position and the first maintenance unit 61 is transferred to the maintenance position (step S5). After that, the sub-scan driver 14 is driven so as to transfer the liquid discharging head 15 to the flushing position (step S6), and a flushing in which the liquid droplets are successively discharged from the nozzles of the liquid discharging head 15, is performed (step S7). Here, when the liquid discharging head 15 reaches the flushing position, the flusher 45 is mechanically operated by the push of a lever or is electrically operated as a sensor detects the liquid discharging head 15. Accordingly, the box shaped container is pressed against the nozzle face of the liquid discharging head 15.

Next, the sub-scan driver 14 is driven so as to transfer the liquid discharging head 15 to the wiping position (step S8), and a wiping is performed by operating the wiper 46 (step S9). In this manner, the cleaning operation of the steps 4 to 9 is completed.

Next, when it is a weight measuring timing (YES in a step S10), an operation for measuring the weight of the discharged liquid is started. If the second maintenance unit 62 is not positioned at the maintenance position (NO in a step S11) and the suction table 19 is not withdrawn, the suction table 19 is withdrawn to the table withdrawal position and the second maintenance unit 62 is transferred to the maintenance position (step S12). After that, the sub-scan driver 14 is driven so as to transfer the liquid discharging head 15 to the weight measuring position of the electronic balance 47 (step 13). Next, a predetermined amount (for example, one hundred liquid droplets) of the functional liquid is discharged on the electronic balance 47, and then the weight of the discharged functional liquid is measured by the electronic balance 47 (step S14). After that, a voltage applied to the piezoelectric element corresponding to each of the nozzles is adjusted so that the properly predetermined amount of the functional liquid is discharged therefrom on the basis of the functional liquid discharge characteristic of each of the nozzles (step S15).

When it is not the cleaning timing or the weight measuring timing (NO in the steps S3 and S10), or when the cleaning operation or the weight measuring operation is completed, the procedure proceeds to a step S16. In the step S16, the maintenance units 61 and 62 are withdrawn to the standby position, and then the substrate 32 is fed by the substrate feeding apparatus 16 in a step S17.

Next, while the substrate 32 is observed by the substrate camera 49, the substrate 32 fixed on the suction table 19 is positioned by rotating the output shaft of the θ motor of the substrate position controller 12 (step S18). The liquid discharging head 15 is positioned by use of the head camera 48, and the discharge starting position is determined by an arithmetic operation (step S19). Then, the main scan driver 13 and the sub-scan driver 14 are properly operated to transfer the liquid discharging head 15 to the discharge starting position with respect to the substrate 32 (step S20).

Next, the main scan is started in the X direction, and the discharge of the functional liquid is started (step S21). Specifically, the substrate 32 is linearly transferred in the main scan direction X at a predetermined speed by operating the main scan driver 13. In this case, when the nozzles reach the discharge position, the liquid droplets are discharged from the nozzles on the basis of the functional liquid discharge signal, which is arithmetically operated by the nozzle discharge control operating unit 410.

When one main scan is completed, the liquid discharging head is transferred by the sub-scan driver 14 in the sub-scan direction Y in a predetermined distance (step S22). Next, the main scan and liquid discharge are repeated (No in a step S23, return to the step S21).

When the operation of discharging the functional liquid on the whole substrate 32 is completed by the liquid discharging head 15 (YES in a step S23), the substrate 32 is discharged to the outside (step S24). After that, if the operator does not order the procedure to be completed (NO in a step S25), the procedure returns to the step S3 and then the operation of discharging the functional liquid is repeatedly performed on another substrate 32.

If the operator orders the procedure to be completed (YES in the step S25), the suction table 19 is withdrawn to the table withdrawal position (step S26). The first the maintenance unit 61 and the second maintenance unit 62 are transferred from the standby position to the maintenance position (step S27). Then, first, the liquid discharging head 15 is transferred to the wiping position by the sub-scan driver 14 (step S28), and the nozzle face of the liquid discharging head 15 is wiped by operating the wiper 46 (step S29).

Next, the liquid discharging head 15 is transferred to the capping position by the sub-scan driver 14 (step S30), and the liquid discharging head 15 is capped by operating the capper 44 (step S31). The serial operation of discharging the functional liquid is completed as described above.

As described above, the withdrawal operation of withdrawing the suction table 19 to the table withdrawal position (step S26), the operation of transferring required one of the maintainers 44 to 47 to the maintenance position (steps S5, S12, S27), the head transfer operation of transferring the liquid discharging head 15 to the position, which corresponds to the maintenance unit in the maintenance position, to perform the maintenance of the liquid discharging head (steps S6, S8, S13, S28, S30), and the maintenance performing operation of performing maintenance by means of the maintainers (steps S7, S9, S14, S29, S31) are performed during the maintenance. After the maintenance, the returning operation of transferring the maintainers to the standby position (step S16) is performed and then the serial maintenance is completed.

Therefore, according to the liquid discharging system 1 of the present embodiment, the following advantages are obtained.

(1) Even when being positioned at any one position of the standby position and the maintenance position, the maintainers 44 to 47 are positioned in the carriage maximum scanning range L in the carriage moving direction (Y direction). Accordingly, even though the carriage 18 just moves in the moving range required to the scan, it is possible to perform maintenance. As a result, the maximum moving range of the carriage 18 is slightly larger than the maximum scanning range L. Accordingly, it is not necessary that the rail track of the carriage 18 be made long so that the carriage 18 can reach the region exceeding the maximum scanning range L (maximum drawing range) to perform maintenance. For this reason, the length of the guide rail 71 can be made shorter than that of the liquid discharging apparatus disclosed in JP-A-10-206624. Therefore, even though the weight of the carriage 18 is increased by mounting auxiliary units, the guide rail 71 is hardly bent, whereby it is possible to easily secure the required positional accuracy for discharging liquid droplets. In addition, since the length of the guide rail 71 can be reduced, it is possible to reduce the size of the liquid discharging apparatus 10 in the carriage moving direction. Furthermore, when being positioned at the standby position, the maintainers 44 to 47 are positioned below the suction table 19, and are positioned in the workpiece maximum scanning range in the table moving direction (X direction). Accordingly, it is possible to further reduce the size of the liquid discharging apparatus 10 in the carriage moving direction, compared to the liquid discharging apparatuses disclosed in JP-A-2001-171135 and JP-A-2003-48312. As described above, the liquid discharging apparatus 10 can be easily made more compact than any one of the liquid discharging apparatuses disclosed in JP-A-10-206624, JP-A-2001-171135, JP-A-2003-48312, and JP-A-2003-230858. In addition, since the length of the guide rail 71 of the liquid discharging apparatus 10 can be made shorter than that of the liquid discharging apparatus disclosed in JP-A-10-206624, it is possible to easily secure the required positional accuracy for discharging liquid droplets.

(2) The maintainers 44 to 47 can be transferred from the standby position to the maintenance position only by only raising and lowering themselves. Since moving devices are composed of the only lifters 56 and 57, it is possible to simply compose the moving devices.

Second Embodiment

In the first embodiment, the maintainers 44 to 47 are arranged along the path of the liquid discharging head 15 in one line. However, in a second embodiment, the maintainers 44 to 47 are arranged in the table moving direction in two lines. In addition, although the mounting location and the configuration of the maintainers in the second embodiment is different from those in the first embodiment, other configurations of the liquid discharging apparatus 10 in the second embodiment is the same as those in the first embodiment. Accordingly, the different maintenance units therebetween will be described in detail.

Figure 6A:
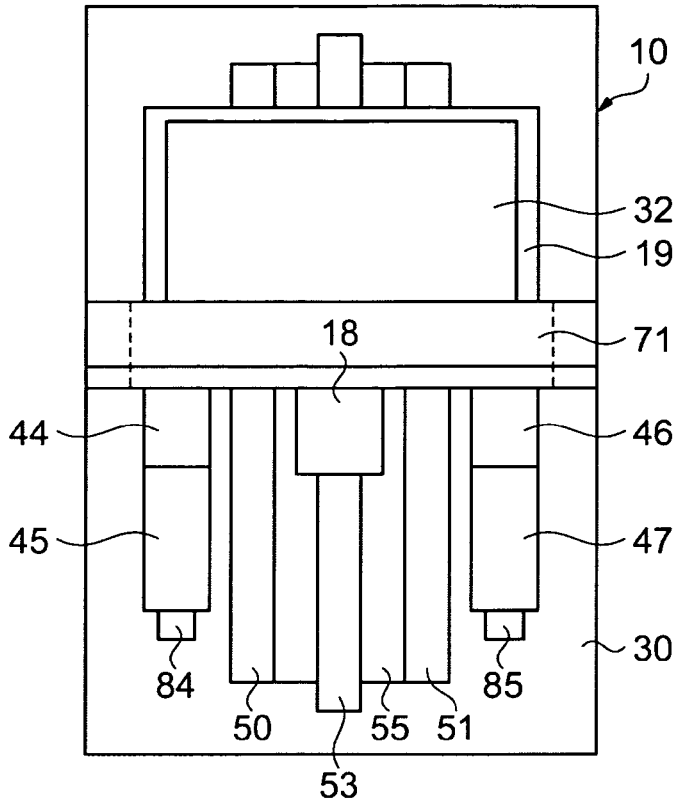
FIG. 6A is a plan view showing a liquid discharging apparatus of a second embodiment.
Figure 6B:
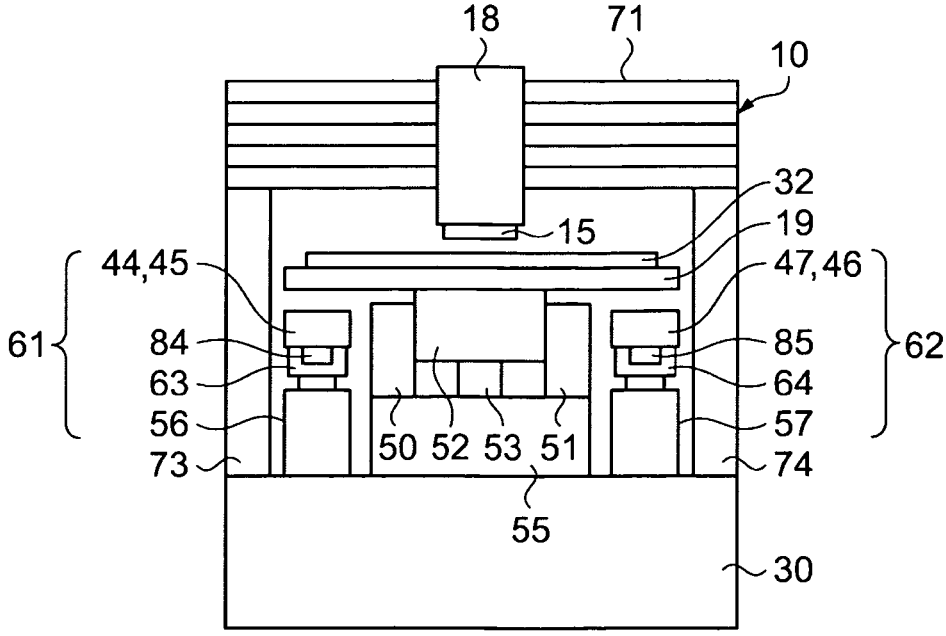
FIG. 6B is a front view showing the liquid discharging apparatus of the second embodiment.

FIG. 6A is a plan view showing the liquid discharging apparatus of the second embodiment, and FIG. 6B is a front view showing the liquid discharging apparatus of the second embodiment. As shown in FIG. 6B, on a base 30 of the liquid discharging apparatus, a first maintenance unit 61 and a second maintenance unit 62 are provided on the both sides of the base plate 55 in the carriage moving direction. The first maintenance unit 61 and the second maintenance unit 62 include lifters 56 and 57 serving as lifting members which are disposed on the base 30, rails 63 and 64 respectively supported by rods of the lifters 56 and 57, and linear motors 84 and 85 serving as driving sources for transferring the maintainers 44 to 47 along the rails 63 and 64 in the table moving direction, respectively. Furthermore, transfer mechanisms, which are composed of the lifters 56 and 57, the rails 63 and 64, and the linear motors 84 and 85, correspond to transfer units. The table moving direction transfer mechanisms, which include the rails 63 and 64, and the linear motors 84 and 85, correspond to first scan direction transfer units. Furthermore, in the present embodiment, the maintenance driving unit 77 in the electric control block diagram shown of FIG. 4 is composed of electromagnetic valves for controlling the lifters (air cylinders) 56 and 57, and the linear motors 84 and 85. Furthermore, each of the lifters 56 and 57 may be composed of an electric direct acting type actuator.

The guide rails 50 and 51, and the linear motor 53 are provided on the upper surface base plate 55 disposed on the upper surface of the base 30 in the middle thereof, and the suction table 19 is supported by the movable table 52 capable of moving along the guide rails 50 and 51. The first and the second maintenance units 61 and 62 are positioned below the suction table 19 in a standby state in which the lifters 56 and 57 are lowered. Moreover, the first and the second maintenance units 61 and 62 are positioned in the carriage maximum scanning range L (see FIG. 2) in the carriage moving direction (horizontal direction in the drawing). In addition, the first and the second maintenance units 61 and 62 are positioned in the workpiece maximum scanning range, which is a maximum moving range during the time when the scan (drawing) is performed on the longest substrate in the X direction, in the table moving direction.

The states shown in FIGS. 6A and 6B are states in which the first and the second maintenance units 61 and 62 are positioned at the standby position. When the first maintenance unit 61 including a pair of maintainers 44 and 45 is positioned at the standby position, the capper 44 is positioned at a junction position that is immediately below the path of the liquid discharging head 15, and the flusher 45 is positioned at the standby position which is out of a predetermined distance from the junction position in the table moving direction. Meanwhile, when the second maintenance unit 62 including a pair of maintainers 46 and 47is positioned at the standby position, the wiper 46 is positioned at a junction position that is immediately below the path of the liquid discharging head 15, and the weight measurer 47 is positioned at the standby position which is out of a predetermined distance from the junction position in the table moving direction. When the lifters 56 and 57 are raised, the maintainers, which are positioned at the junction position, of the maintainers 44 to 47 are poisitioned at the maintenance position in which the maintenance of the liquid discharging head 15 can be performed. In addition, the arrangement order of the maintainers 44 to 47 is not limited.

During the maintenance, first, the suction table 19 on which the substrate 32 is lain is withdrawn to the table withdrawal position in which the suction table 19 does not interfere with the maintenance units 61 and 62 to be raised. Next, a pair of maintainers, which is used to perform maintenance at that time, of the maintainers 44 to 47 is transferred from the standby position in the table moving direction by the linear motors 84 and 85. And then, one maintainer, which is used to perform maintenance at that time, is positioned at a junction position that is immediately below the path of the liquid discharging head 15. After that, one lifter, which supports a maintainer used to perform maintenance, of the lifters 56 to 57 is operated, and thus the maintainer is raised from the junction position to the maintenance position so as to perform the maintenance of the liquid discharging head 15.

According to the second embodiment, it is possible to also obtain the following advantages as well as the advantages of the first embodiment which can reduce the size of the liquid discharging apparatus and easily secure the required positional accuracy for discharging liquid droplets.

(1) Since the maintainers 44 to 47 are arranged in the table moving direction in two lines, it is possible to secure the space for mounting maintainers 44 to 47 in the table moving direction. Accordingly, the maintainers 44 to 47 can have various functions. Furthermore, the maintenance units 61 and 62 are provided outside of the guide rails 51 and 52 for guiding the suction table 19 so that the maintainers 44 and 47 are disposed on the outside of the carriage in the carriage moving direction of the liquid discharging apparatus and are arranged in line in the table moving direction. Therefore, it is possible to perform the maintenance of the maintainers 44 and 47.

Third Embodiment

In the first embodiment and the second embodiment, the maintainers are provided in the maximum scanning range. However, in a third embodiment, the maintainers are provided in the carriage maximum scanning range at the maintenance position.

Figure 7A:
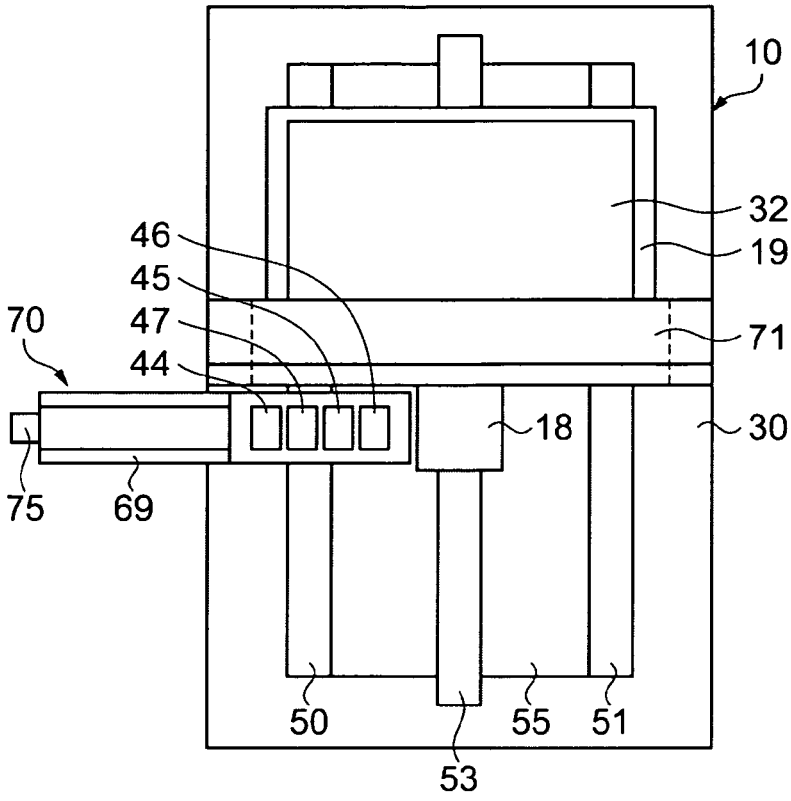
FIG. 7A is a plan view showing a liquid discharging apparatus of a third embodiment.
Figure 7B:
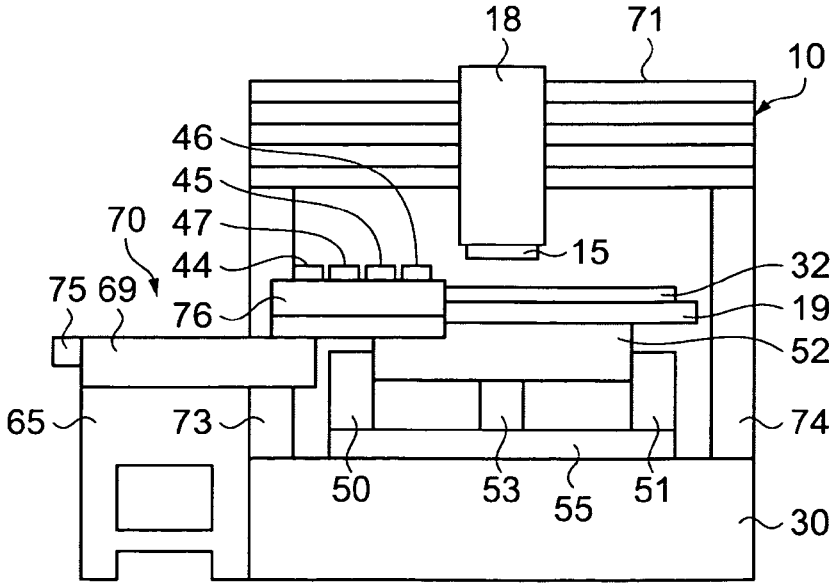
FIG. 7B is a front view showing the liquid discharging apparatus of the third embodiment.

FIG. 7A is a plan view of a liquid discharging apparatus according to a third embodiment, and FIG. 7B is a front view thereof.

As shown in 7B, a maintenance unit 70 is provided at one end of the liquid discharging apparatus 10 in the carriage moving direction. The maintenance unit 70 is supported on a maintenance base 65 positioned close to one end of a base 30 in the carriage moving direction. The maintenance unit 70 includes a guide rail 69 that is mounted on the maintenance base 65, a stage 76 that is guided by the guide rail 69 so as to move in the direction parallel to the carriage moving direction, a motor 75 serving as a driving source that transfers the stage 76, and maintainers 44 to 47 that are arranged on the stage 76 in one line along the carriage moving direction. The power of the motor 75 is transmitted to the stage 76 by a power transmission device (not shown) including, for example, a ball screw, a drive belt, etc., and thus the stage 76 is transferred along the guide rail 69 by the transmitted power. In addition, in the present embodiment, the maintenance driving unit 77 shown in the electric control block diagram of FIG. 4 is composed of a motor. Furthermore, a transfer mechanism, which is composed of the guide rail 69, the stage 76, and the motor 75, corresponds to a transfer unit and a second scan direction transfer units.

As shown in FIGS. 7A and 7B, the stage 76 reciprocates between the standby position in which the stage is withdrawn to a position overlapped with the guide rail 69, and the operating position in which the stage is transferred from the standby position toward the suction table 19. When the stage 76 is positioned at the standby position, the maintainers 44 to 47 are disposed at the standby position, and when the stage 76 is positioned at the operating position, the maintainers 44 to 47 are disposed at the maintenance position shown in FIG. 7. When being positioned at the standby position, the maintainers 44 to 47 are positioned on the outer extension line of the path of the liquid discharging head 15. When being positioned at the maintenance position, the maintainers 44 to 47 are positioned in the carriage maximum scanning range L. Furthermore, in the table moving direction (vertical direction in FIG. 7A), the maintenance unit 70 is positioned in the workpiece maximum scanning range. In addition, the arrangement order of the maintainers 44 to 47 composing the maintenance unit 70 is not limited to the arrangement order shown in FIGS. 7A and 7B, and can be properly modified.

During the maintenance, first, the suction table 19 on which the substrate 32 is lain is withdrawn to the table withdrawal position in which the suction table 19 does not interfere with the maintainers 44 to 47. Next, by the driving of the motor 75, the maintainers 44 to 47 are transferred to the maintenance position in the carriage maximum scanning range L (see FIG. 2). The carriage 18 is transferred along the guide rail 71 substantially simultaneously with the transfer of the maintainers 44 to 47 to the maintenance position, and thus the liquid discharging head 15 is transferred to the predetermined position corresponding to a position when a maintainer, which is used to perform maintenance at that time, of the maintainers 44 to 47 is transferred to the maintenance position. Then, the maintainer, which is used to perform maintenance at that time, performs the maintenance of the liquid discharging head 15. After the maintenance is completed, the maintainer returns to the standby position through the moving path.

According to the third embodiment, when being positioned at the maintenance position, the maintainers 44 to 47 are positioned in the carriage maximum scanning range L. Accordingly, it is possible to make the guide rail 71 short. For this reason, even though the weight of the carriage 18 is increased, the guide rail 71 is hardly bent, whereby it is possible to easily secure the required positional accuracy for discharging liquid droplets. Furthermore, since the maintenance unit 70 is positioned close to the outside of the liquid discharging apparatus 10, it is possible to perform the maintenance of the maintainers 44 to 47. Moreover, although the maintenance unit 70 positioned at the standby position protrudes to the outside of the base 30, the protruding portion of the maintenance unit has a smaller width in the table moving direction than that of the guide rail 71. Accordingly, it is possible to make the liquid discharging apparatus substantially narrow in the carriage moving direction. In addition, since the maintenance unit 70 is positioned in the workpiece maximum scanning range in the table moving direction, it is possible to also reduce the size of the liquid discharging apparatus in the table moving direction.

Fourth Embodiment

A fourth embodiment is a modification of the third embodiment, and is different from the third embodiment in that a plurality of maintainers positioned aside of the base is arranged in one line in the table moving direction.

Figure 8A:
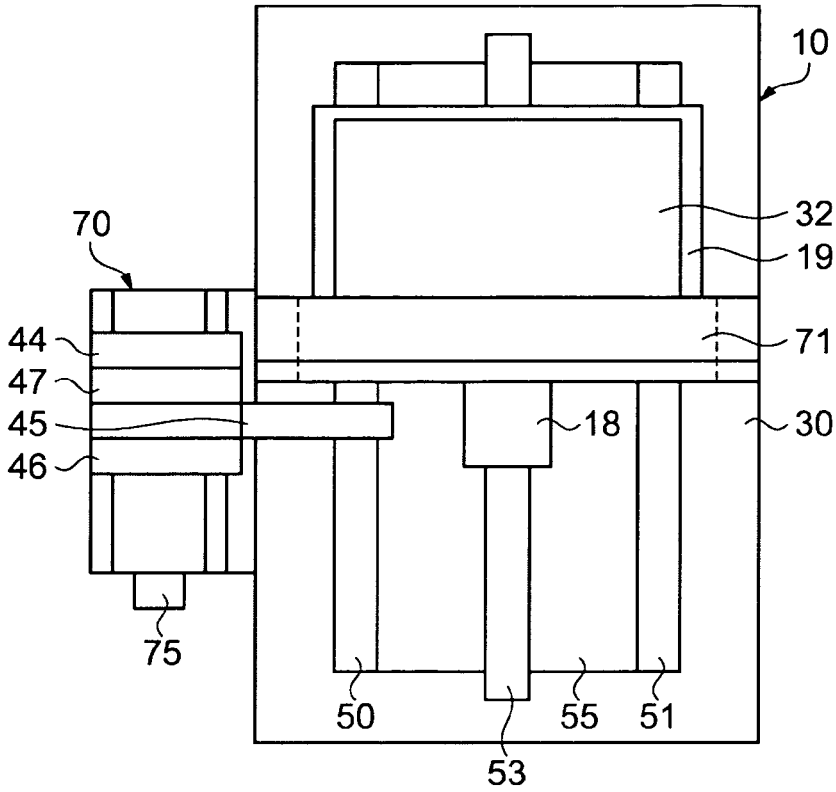
FIG. 8A is a plan view showing a liquid discharging apparatus of a fourth embodiment.
Figure 8B:
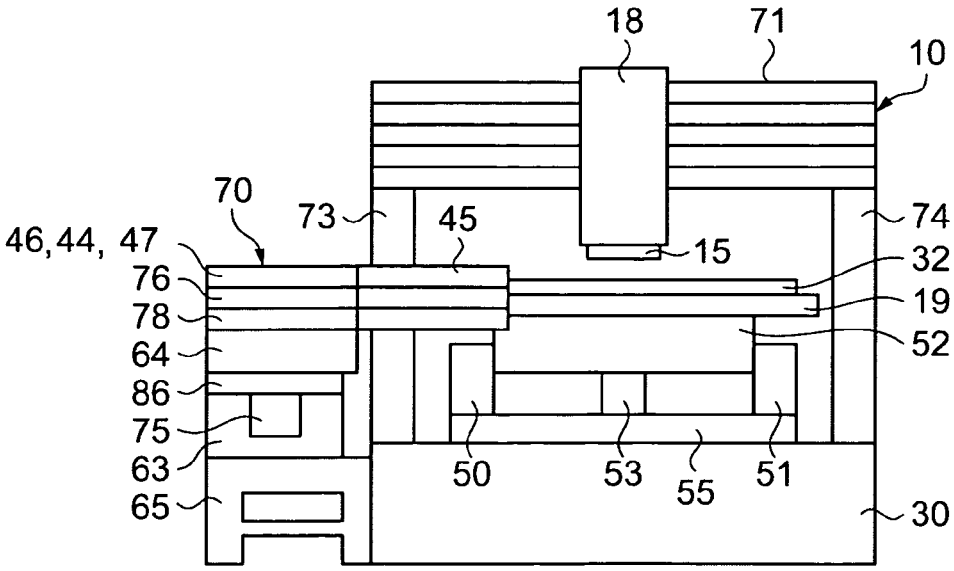
FIG. 8B is a front view showing the liquid discharging apparatus of the fourth embodiment.

FIG. 8A is a plan view of a liquid discharging apparatus according to the fourth embodiment, and FIG. 8B is a front view thereof.

The maintenance base 65 is provided at one end of the liquid discharging apparatus 10 shown in FIG. 8B in the carriage moving direction so as to be adjacent to the base 30, and the maintenance unit 70 is mounted on the maintenance base 65. The configuration of the maintenance unit 70 is different from that of the third embodiment. The maintenance unit 70 includes an upper mechanism and a lower slide mechanism, which can slide in the table moving direction and in the carriage moving direction, respectively, and the plurality of maintainers 44 to 47 is provided on the mechanisms. The lower slide mechanism includes a guide rail 63 that is provided on the maintenance base 65, a stage 86 that is guided by the guide rail 63 so as to move in the direction parallel to the table moving direction, and a motor 75 serving as a driving source that transfers the stage 86. The upper slide mechanism includes a guide rail 64 that is fixed on the stage 86, four lines of stages 76 that are guided by the guide rail 64 so as to move in the direction parallel to the carriage moving direction, and four air cylinders 78 serving as driving sources that transfers the four lines of stages 76, respectively. Each of the maintainers 44 to 47 is mounted on each of the stages 76 composing the upper slide mechanism so as to be arranged in one line along the table moving direction. Furthermore, in the present embodiment, the maintenance driving unit 77 shown in the electric control block diagram of FIG. 4 is composed of a motor 75, and electromagnetic valves for controlling the supply and exhaust of compressed air that is required to operate the air cylinders 78. In addition, the upper and the lower slide mechanisms composing the maintenance unit 70 correspond to the transfer unit. The lower slide mechanism further including the motor 75 composes the first scan direction transfer unit, and the upper slide mechanism including the air cylinders 78 composes the second scan direction transfer unit.

When the motor 75 of the lower slide mechanism is driven, the four maintainers 44 to 47 move in the table moving direction, and thus one maintainer, which is used to perform maintenance, is positioned at the junction position on the extension line of the path of the liquid discharging head 15. After that, when the air cylinders 78 of the lower slide mechanism is operated, the maintainer positioned at the junction position moves so as to be extended toward the suction table 19 in the carriage moving direction and then is positioned at the maintenance position in the carriage maximum scanning range L (see FIG. 2). In the embodiment shown in FIG. 8, the flusher 45 is positioned at the maintenance position. In the present embodiment, all of the maintainers 44 to 47 is withdrawn to the outside of the base 30 in the carriage moving direction, and the state in which the capper 44 is positioned at the junction position is used as the standby position of the maintenance unit 70. When the maintenance unit 70 is positioned at the standby position, the position of the respective maintainers 44 to 47 is used as the standby position thereof. In addition, the arrangement order of the maintainers 44 to 47 composing the maintenance unit 70 is not limited to the arrangement order shown in FIGS. 8A and 8B, and can be properly modified.

During the maintenance, the suction table 19 is withdrawn to the table withdrawal position, and the motor 75 of the lower slide mechanism of the maintenance unit 70 is driven. Accordingly, the maintainer, which is used to perform maintenance, is positioned at the maintenance position via the junction position. At about that time, the carriage 18 moves, and then the liquid discharging head 15 is positioned so as to correspond to the maintainer positioned at the maintenance position. After the maintenance is completed, the maintainer returns to the standby position through the moving path.

According to the fourth embodiment, the maintainers 44 to 47 are arranged in one line in the table moving direction, and are transferred to the maintenance position in the carriage moving direction one by one. Accordingly it is possible to make the moving stroke in the carriage moving direction shorter than that of the third embodiment. For this reason, since the protruding distance of the maintenance unit 70 in the carriage moving direction can be made shorter than that of the third embodiment, it is possible to further reduce the size of the liquid discharging apparatus in the carriage moving direction, compared to that of the third embodiment.

First Modification

Although the standby position of the maintenance unit is positioned below the suction table and aside of the suction table, the standby position is not limited thereto. The standby position of the maintenance unit may be positioned above the suction table 19. A gate type supporter is provided from the upper surface of the base 30 toward the upper side over the suction table, and a lifter (lifting unit) having a projectable rod is disposed on the lower side of the supporter. Then, the slide mechanism that can slide toward the liquid discharging head 15 in the table moving direction is supported on the rod of the lifter, and the maintainers 44 to 47 are disposed on the stage of the slide mechanism. During the maintenance, after the suction table 19 is withdrawn, the maintainers 44 to 47 are lowered from the standby state to the junction position, and then are transferred to the maintenance position from the junction position in the table moving direction. According to the first modification, a structure such as the gate type supporter is added. However, it is possible to obtain the advantages similar to those of the second embodiment in which the bottom area and the size of the liquid discharging apparatus 10 can be further reduced than those of the third and the fourth embodiments.

Second Modification the transfer mechanism of the maintainers may adopt a structure combining rotational movement and linear movement. In the fourth embodiment, a structure, which combines the lower slide mechanism capable of sliding in the table moving direction and the upper slide mechanism capable of sliding in the carriage moving direction, is used as a transfer mechanism of the maintenance unit 70. However, a structure combining rotational movement and linear movement may be used as the transfer mechanism of the maintenance unit 70. A rotational table is disposed on the maintenance base 65, and a plurality of slide mechanisms to be extended in the radial direction is disposed on the rotational table. Each of the maintainers 44 to 47 is on each of the slide mechanisms.

Third Modification when a plurality of maintenance units is arranged, the arrangement of the maintenance units is not limited to the structure, in which the maintenance units are arranged in the moving direction of the carriage 18 (the first embodiment and the third embodiment), or the maintenance units are arranged in the moving distance of the table (the second embodiment and the fourth embodiment). The arrangement of the maintenance units may adopt the combination of the moving direction of the carriage and the moving direction of the table. For example, the capper 44 and the flusher 45 are arranged in the carriage moving direction, and the wiper 46 and the electronic balance 47 are arranged in the table moving direction. In the third modification, the maintainers 44 to 47 are most suitably arranged in consideration of the size thereof, whereby it is possible to make the structure of the apparatus simple.

Fourth Modification

Although two maintenance units are separately used in the first embodiment, only one maintenance unit can be used by disposing all of the maintainers 44 to 47 on one movable plate supported by the rod of the lifter. For example, the linear motor 53 is approached to one guide rail 51, and then the maintenance unit is disposed between the linear motor 53 and the one guide rail 51. Since it is not necessary that two maintenance units be separately controlled in this configuration, it is possible to easily control the maintenance unit, and to use only one lifter. When only one lifter is used, it is possible to make the transfer mechanism of the maintainers 44 to 47 simple. In addition, it is possible to form the maintenance units as one unit by disposing all of the maintainers 44 to 47 on one movable plate. Moreover, it is possible to use four maintenance units so that each of the maintainers 44 to 47 is separately lifted.

Fifth Modification the capper 44 and the flusher 45 may be replaced with one maintainer, which serves as both the capper and the flusher. The maintainer includes a box shaped container that can come in close contact with the liquid discharging head 15, and the box shaped container may be provided with an excretory tube for discharging the liquid that is received during the flushing. When the box shaped container comes in contact with the liquid discharging head 15, the maintainer serves as a capper. When the maintainer discharges liquid droplets in a state in which the box shaped container comes in contact with the liquid discharging head 15, the maintainer serves as a flusher. Since the number of the maintainers can be reduced in the fifth modification, it is possible to make the maintenance unit simple and compact.

Sixth Modification

Although all of the maintainer 44 to 47 is positioned in the carriage maximum scanning range L in the first and the second embodiments, the configuration of the maintainers is not limited thereto. For example, in the first embodiment, two maintainers, which are disposed at the both side in the carriage moving direction, of the four maintainers 44 to 47 may be partially positioned in the carriage maximum scanning range L. Further, in the second embodiment, only a part of the four maintainers 44 to 47 may be positioned in the carriage maximum scanning range L. If the maintenance of the liquid discharging head 15 is performed by means of the maintainers 44 to 47 in the carriage maximum scanning range L, only a part of the maintainers may be positioned in the carriage maximum scanning range. Furthermore, in the liquid discharging apparatus including a plurality of maintainers, at least one maintainer may be positioned in the carriage maximum scanning range L. In this case, it is possible to reduce a length of a guide rail 71 for the one maintainer.

What is claimed is:

1. A liquid discharging apparatus comprising:

a table that transfers a workpiece in a first scan direction;

a carriage that has a liquid discharging head for discharging liquid droplets on the workpiece, and moves along a guide member in a second scan direction;

one or more maintainers that are used to perform maintenance such as cleaning of the liquid discharging head; and transfer units that transfers the maintainers to a standby position in which the maintainers does not interfere with the table to be scanned, and a maintenance position in which the maintenance of the liquid discharging head is performed, wherein when the maintainers are positioned at the standby position, at least a part of the maintainers is positioned in a workpiece maximum scanning range, which is a maximum moving range of the workpiece in the first scan direction during the scanning of the workpiece on the table, and when the maintainers are positioned at the maintenance position, at least a part of the maintainers is positioned in a workpiece maximum scanning range of the carriage in the second scan direction, which is a maximum moving range during the scanning of the carriage.

2. The liquid discharging apparatus according to claim 1, wherein at the beginning of the maintenance, the table is withdrawn to a table withdrawal position in which the table does not interfere with the maintainers, and the maintainers are transferred from the standby position to the maintenance position by the transfer units, and after the completion of the maintenance, the maintainers are withdrawn to the standby position from the maintenance position.

3. The liquid discharging apparatus according to claim 1, wherein the maintainers are positioned at a lower position of the table, which is immediately below the path of the liquid discharging head, serving as the standby position, and the transfer units are lifters that raise and lower the maintainers between the standby position and the maintenance position.

4. The liquid discharging apparatus according to claim 3, wherein the plurality of maintainers are arranged immediately below the path of the liquid discharging head in one line in the carriage moving direction.

5. The liquid discharging apparatus according to claim 1, wherein the plurality of maintainers are arranged in at least one line in the direction substantially parallel to the scan direction of the table, and uses the lower position of the table as a standby position, and the transfer units includes a first scan direction transfer unit for transferring at least a maintainer of the maintainers which is used to perform maintenance between the standby position and a junction position, which is immediately below the path of the liquid discharging head, in a direction substantially parallel to the scan direction of the table, and lifters for raising and lowering the maintainers between the standby position and the maintenance position.

6. The liquid discharging apparatus according to claim 1, wherein the maintainers are positioned at an outer position of the table, serving as the standby position, on an extension line of the path of the liquid discharging head.

7. The liquid discharging apparatus according to claim 6, wherein the plurality of maintainers are arranged in one line along the scan direction of the carriage, and the transfer units includes a second scan direction transfer unit for transferring the maintainers between the standby position and the maintenance position in the second scan direction.

8. The liquid discharging apparatus according to claim 1, wherein the plurality of maintainers is positioned at an outer position of the table serving as the standby position, and the plurality of maintainers are arranged in one line in the scan direction of the table, and the transfer units includes a first scan direction transfer unit for transferring a first maintainer of the maintainers which is used to perform maintenance between the standby position and a junction position, which is positioned on the extension line of the path of the liquid discharging head, in the first scan direction, and a second scan direction transfer unit for transferring the first maintainer between the junction position and the maintenance position in the second scan direction.

9. The liquid discharging apparatus according to claim 1, wherein before of the maintenance, the liquid discharging head is positioned at a predetermined position, which corresponds to the maintenance position of the maintainers, by transferring the carriage.

10. The liquid discharging apparatus according to claim 1, wherein at least one of a capper, a wiper, and a flusher, which are used to perform the cleaning of the liquid discharging head, is used as the maintainer.

11. The liquid discharging apparatus according to claim 1, further comprising:

a weight measuring unit that measures the weight of functional liquid to be discharged from the liquid discharging head as the maintainer.

12. A liquid discharging apparatus comprising:

a table that transfers a workpiece in a first scan direction;

a carriage that has a liquid discharging head for discharging liquid droplets on the workpiece, and moves along a guide member in a second scan direction;

one or more maintainers that are used to perform maintenance such as cleaning of the liquid discharging head; and transfer units that the transfers the maintainers to a standby position in which the maintainers do not interfere with the table, and a maintenance position in which the maintenance of the liquid discharging head is performed, wherein when being positioned at the standby position, the maintainers are positioned at a lower position of the table in which the maintainers do not interfere with the table to be scanned, and the transfer units includes lifters for raising and lowering the maintainers between the height of the standby position and height of the maintenance position, during the period when maintainers moves between the standby position and the maintenance position.

13. A method of performing maintenance on a liquid discharging apparatus, comprising:

providing a the liquid discharging apparatus, wherein the liquid discharging apparatus comprising:

a table that transfers a workpiece in a first scan direction;

a carriage that has a liquid discharging head for discharging liquid droplets on the workpiece, and moves along a guide member in a second scan direction;

one or more maintainers that are used to perform maintenance such as cleaning of the liquid discharging head; and transfer units that transfers the maintainers to a standby position in which the maintainers does not interfere with the table to be scanned, and a maintenance position in which the maintenance of the liquid discharging head is performed, wherein when the maintainers are positioned at the standby position, at least a part of the maintainers is positioned in a workpiece maximum scanning range, which is a maximum moving range of the workpiece in the first scan direction during the scanning of the workpiece on the table, and when the maintainers are positioned at the maintenance position, at least a part of the maintainers is positioned in a workpiece maximum scanning range of the carriage in the second scan direction, which is a maximum moving range during the scanning of the carriage;

transferring the table to a table withdrawal position in which the table does not interfere with maintainers;

transferring the maintainers from the standby position to the maintenance position;

positioning the liquid discharging head at a predetermined position so as to correspond to the maintainers positioned at the maintenance position by transferring the carriage; and performing maintenance on the liquid discharging head by the maintainers positioned at the maintenance position.

* * * * *